US009555962B1

(12) United States Patent
Stravitz

(10) Patent No.: US 9,555,962 B1
(45) Date of Patent: Jan. 31, 2017

(54) WASTE CONTAINERS WITH BAG TRAPPING STRUCTURE

(71) Applicant: David M Stravitz, New York, NY (US)

(72) Inventor: David M Stravitz, New York, NY (US)

( * ) Notice: Subject to any disclaimer, the term of this patent is extended or adjusted under 35 U.S.C. 154(b) by 0 days.

(21) Appl. No.: 14/709,878

(22) Filed: May 12, 2015

Related U.S. Application Data

(60) Continuation-in-part of application No. 14/537,044, filed on Nov. 10, 2014, now Pat. No. 9,181,028, which is a division of application No. 14/109,270, filed on Dec. 17, 2013, now Pat. No. 8,910,821.

(60) Provisional application No. 61/881,386, filed on Sep. 23, 2013.

(51) Int. Cl.
*B65F 1/06* (2006.01)
*B65F 1/14* (2006.01)
*B65B 67/12* (2006.01)

(52) U.S. Cl.
CPC ..... *B65F 1/06* (2013.01); *B65B 67/1233* (2013.01); *B65F 1/1415* (2013.01)

(58) Field of Classification Search
CPC ..... B09B 3/0025; B09B 3/0075; B65B 9/15; B65B 67/1277; B65B 67/12; B65B 67/1205; B65B 67/1211; B65B 67/1216; B65B 67/1222; B65B 67/1227; B65B 67/1233; B65F 1/062; B65F 1/1607; B65F 1/16; B65F 1/06; B65F 1/14; B65F 1/04; B65F 7/00; B65F 1/141; B65F 1/1415; A01M 1/2055; B65D 2251/1016
USPC ..... 248/99–101; 220/833, 834, 908, 908.1, 220/495, 8, 495.06, 320, 315, 324
See application file for complete search history.

(56) References Cited

U.S. PATENT DOCUMENTS

| | | | | |
|---|---|---|---|---|
| 1,719,185 | A | 7/1929 | Lowy | |
| 2,434,238 | A | 1/1948 | Wolfson | |
| 2,793,373 | A | 5/1957 | Ewing | |
| 3,214,065 | A | 10/1965 | Thornton | |
| 4,427,110 | A | 1/1984 | Shaw, Jr. | |
| 4,902,482 | A | 2/1990 | Faust | |
| 5,174,462 | A | 12/1992 | Hames | |
| D334,975 | S | 4/1993 | Bunce et al. | |
| 5,520,303 | A | 5/1996 | Bernstein et al. | |
| 5,556,063 | A | 9/1996 | Boyd | |
| 5,836,553 | A * | 11/1998 | Bergaila | B65F 1/1415 248/101 |
| 5,988,520 | A | 11/1999 | Bitner | |
| 6,206,221 | B1 * | 3/2001 | Bando | B65D 47/0871 220/254.5 |
| D457,283 | S | 5/2002 | Wayt | |

(Continued)

*Primary Examiner* — Andrew Perreault
(74) *Attorney, Agent, or Firm* — Brian Roffe

(57) ABSTRACT

Waste container includes a base defining a waste-receiving compartment, and an insert supported on the base and adapted to engage a peripheral edge of a bag that extends into the compartment while maintaining an opening of the bag unobstructed. The insert has at least one bag-engagement edge and possibly up to four such edges. A movable closure component has a first engagement position in which the closure component engages with the insert to press the bag when present against the at least one bag-engagement edge of the insert, and a second non-engagement position in which the closure component is separated from the at least one bag-engagement edge of the insert. A lid is preferably attached to the base and movable between a first, closed position covering the opening of the bag and a second, open position in which it does not obstruct the opening of the bag.

9 Claims, 33 Drawing Sheets

(56) References Cited

U.S. PATENT DOCUMENTS

| | | | | |
|---|---|---|---|---|
| 6,540,103 | B2 | 4/2003 | Silvers | |
| 6,612,099 | B2 | 9/2003 | Stravitz | |
| D485,404 | S | 1/2004 | Del Prato | |
| 6,679,462 | B1 * | 1/2004 | Valdez | B65B 67/1211 248/101 |
| 6,804,930 | B2 | 10/2004 | Stravitz | |
| 6,837,394 | B2 | 1/2005 | Nnamani | |
| 6,851,251 | B2 | 2/2005 | Stravitz | |
| 6,904,867 | B2 | 6/2005 | Zamjahn | |
| 6,974,029 | B2 | 12/2005 | Morand et al. | |
| 7,086,569 | B2 | 8/2006 | Stravitz | |
| 7,114,314 | B2 | 10/2006 | Stravitz | |
| 7,146,785 | B2 | 12/2006 | Stravitz | |
| D537,598 | S | 2/2007 | Moore | |
| 7,225,943 | B2 | 6/2007 | Yang et al. | |
| 7,316,100 | B2 | 1/2008 | Stravitz et al. | |
| 7,406,814 | B2 | 8/2008 | Morand | |
| 7,434,377 | B2 | 10/2008 | Stravitz et al. | |
| 7,503,152 | B2 | 3/2009 | Stravitz et al. | |
| 7,503,159 | B2 | 3/2009 | Stravitz et al. | |
| 7,516,865 | B1 | 4/2009 | Pierre | |
| 7,543,716 | B2 | 6/2009 | Lin | |
| D596,364 | S | 7/2009 | Morand | |
| 7,617,659 | B2 | 11/2009 | Stravitz et al. | |
| 7,696,711 | B2 | 4/2010 | Pollack et al. | |
| 7,708,188 | B2 | 5/2010 | Stravitz et al. | |
| 7,712,285 | B2 | 5/2010 | Stravitz et al. | |
| D619,905 | S | 7/2010 | Dunn et al. | |
| 7,878,359 | B1 | 2/2011 | Ko | |
| 7,931,150 | B2 | 4/2011 | Morand | |
| D639,002 | S | 5/2011 | Dunn et al. | |
| D639,003 | S | 5/2011 | Dunn et al. | |
| D639,004 | S | 5/2011 | Dunn et al. | |
| 7,963,414 | B1 | 6/2011 | Stravitz | |
| D652,189 | S | 1/2012 | Morand | |
| D654,738 | S | 2/2012 | Morand | |
| 8,127,519 | B2 | 3/2012 | Stravitz | |
| D657,107 | S | 4/2012 | Fitzpatrick et al. | |
| 8,215,089 | B2 | 7/2012 | Stravitz | |
| 8,235,237 | B1 | 8/2012 | Stravitz | |
| 8,266,871 | B1 | 9/2012 | Stravitz | |
| 8,393,489 | B1 | 3/2013 | Stravitz | |
| 8,567,157 | B2 | 10/2013 | Dunn et al. | |
| 8,635,838 | B2 | 1/2014 | Dunn et al. | |
| 8,647,587 | B2 | 2/2014 | Dunn et al. | |
| 8,657,139 | B1 | 2/2014 | Bodine | |
| 8,690,017 | B2 | 4/2014 | Dunn et al. | |
| 8,739,501 | B2 | 6/2014 | Dunn et al. | |
| 8,752,724 | B2 | 6/2014 | Babikian et al. | |
| 8,833,592 | B2 | 9/2014 | Dunn et al. | |
| 8,834,023 | B1 | 9/2014 | Laera | |
| 8,844,751 | B2 | 9/2014 | Sakaguchi et al. | |
| 8,899,420 | B2 | 12/2014 | Morand | |
| 8,910,821 | B1 | 12/2014 | Stravitz | |
| 8,959,880 | B2 | 2/2015 | Morand | |
| 8,973,774 | B1 | 3/2015 | Stravitz | |
| D728,184 | S | 4/2015 | Hoggatt et al. | |
| 9,085,404 | B2 | 7/2015 | Dunn et al. | |
| 2002/0051739 | A1 | 5/2002 | Wang | |
| 2005/0056649 | A1 | 3/2005 | Simonson et al. | |
| 2008/0134644 | A1 | 6/2008 | Knuth et al. | |
| 2008/0264948 | A1 | 10/2008 | Kovacevich et al. | |
| 2009/0046955 | A1 | 2/2009 | Schember et al. | |
| 2010/0005762 | A1 | 1/2010 | Stravitz | |
| 2010/0140423 | A1 | 6/2010 | Davies et al. | |
| 2011/0099958 | A1 | 5/2011 | Dunn et al. | |
| 2012/0211494 | A1 | 8/2012 | Morand | |
| 2013/0181000 | A1 | 7/2013 | Miksovsky et al. | |
| 2013/0252534 | A1 | 9/2013 | Smith | |
| 2014/0027452 | A1 | 1/2014 | Pan | |
| 2014/0042168 | A1 | 2/2014 | Dunn et al. | |

* cited by examiner

FIG. 37
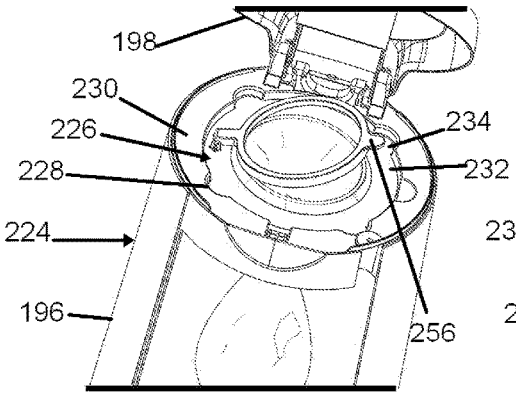
FIG. 38
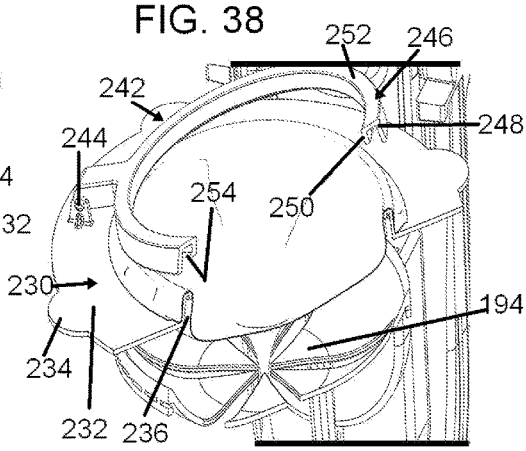
FIG. 39
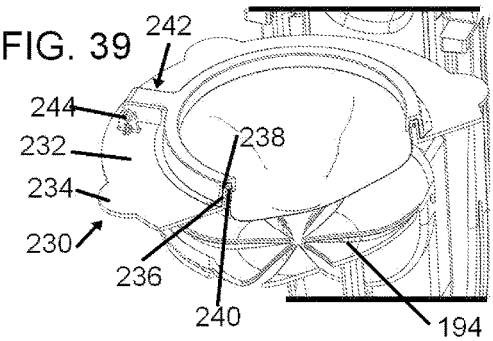
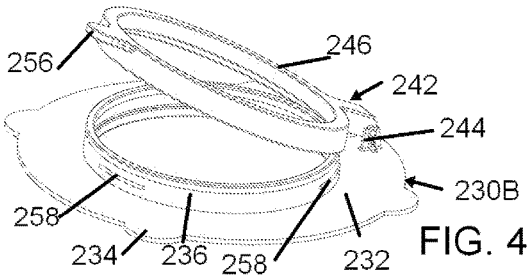
FIG. 41
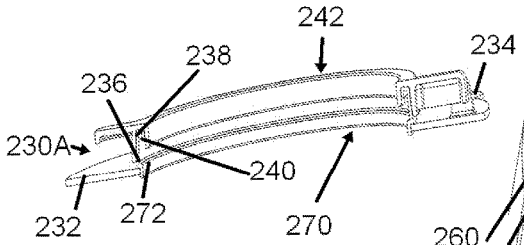
FIG. 40
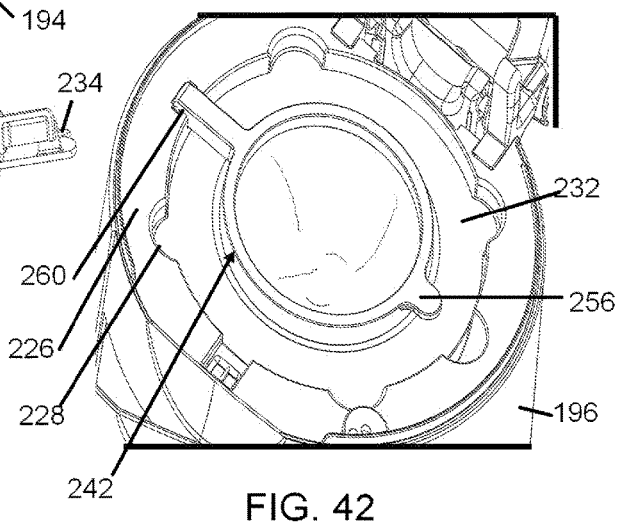
FIG. 42

FIG. 45
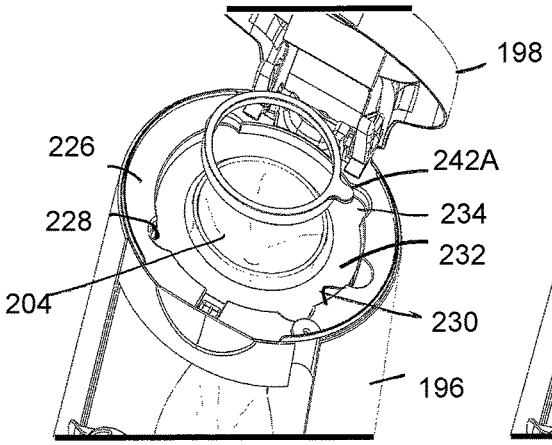
FIG. 46
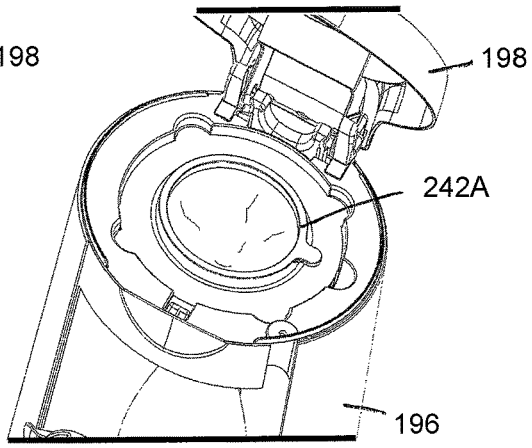
FIG. 47
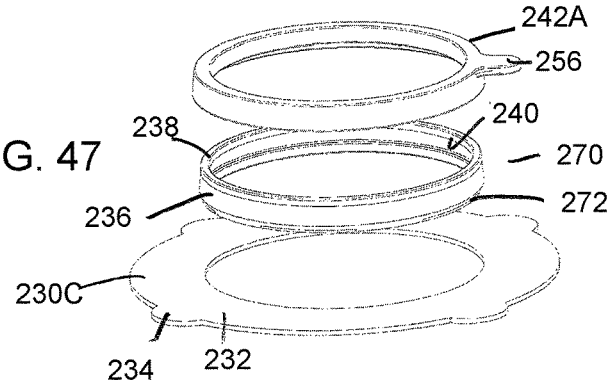
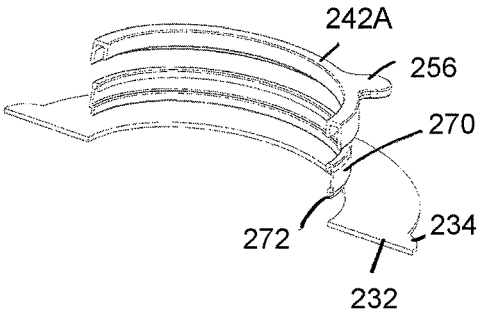
FIG. 48

FIG. 49
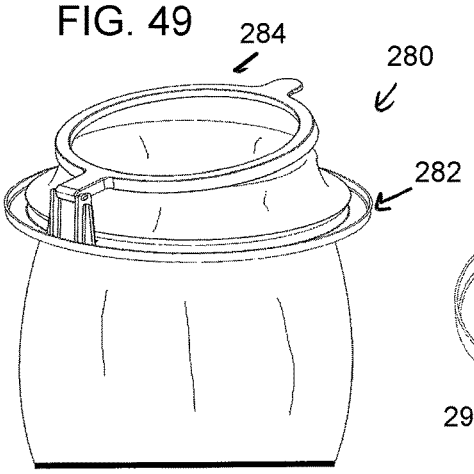
FIG. 50
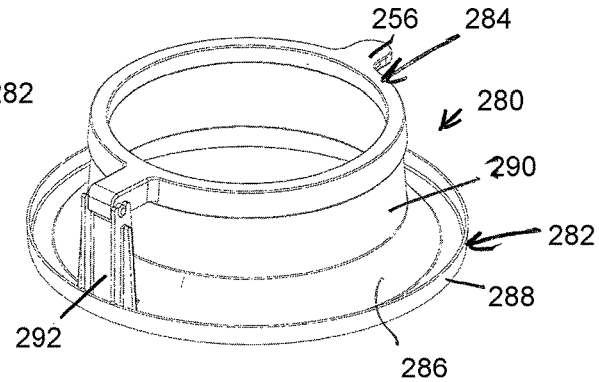
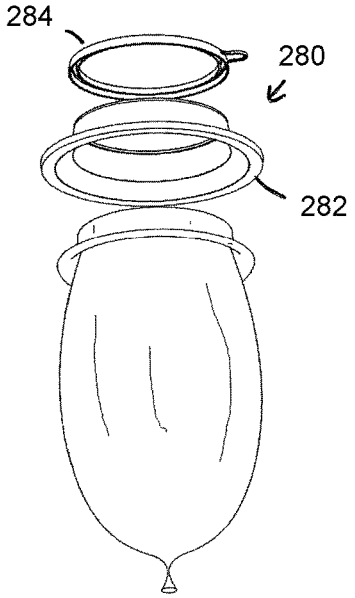
FIG. 51

WASTE CONTAINERS WITH BAG TRAPPING STRUCTURE

CROSS-REFERENCE TO RELATED APPLICATIONS

This application is a continuation-in-part of U.S. patent application Ser. No. 14/537,044 filed Nov. 10, 2014, which is a divisional of U.S. patent application Ser. No. 14/109,270 filed Dec. 17, 2013, now U.S. Pat. No. 8,910,821, which claims priority under 35 U.S.C. §119 of U.S. provisional patent application Ser. No. 61/881,386 filed Sep. 23, 2013, all of which are incorporated by reference herein.

FIELD OF THE INVENTION

The present invention relates generally to waste disposal device that may be used for any type of waste, including but not limited to, cat litter, medical waste from hospitals, doctors' offices, home health care personnel and facilities, nursing homes, biohazard laboratories, diapers, general household waste, disposables and the like, and include structure that securely retains or traps a bag so that the bag does not fall into the waste receptacle when waste is inserted.

BACKGROUND OF THE INVENTION

Waste disposal devices are common in hospitals, doctors' offices, kitchens and other household locations and other locations where waste is generated and must be disposed of in a sanitary manner. Waste disposal devices are also often used to dispose of household waste, cat litter and other pet waste. If the waste emits odors, the waste disposal device should also contain odors emanating from the waste.

Numerous waste disposal devices exist including those disclosed in U.S. Pat. Nos. 6,612,099, 6,804,930, 6,851,251, 7,086,569, 7,114,314, 7,146,785, 7,316,100, 7,434,377, 7,503,152, 7,503,159, 7,617,659, 7,708,188, 7,712,285, 7,963,414, 8,127,519, 8,215,089, 8,235,237, 8,266,871, 8,973,774 and all of which are incorporated by reference herein. Additionally, innovative waste disposal devices are disclosed in U.S. patent application Ser. No. 12/172,715 filed Jul. 14, 2008, now abandoned, Ser. No. 13/172,976 filed Jun. 30, 2011, now abandoned, and Ser. No. 13/270,697 filed Oct. 11, 2011, now abandoned, all of which are incorporated by reference herein.

Some of these waste disposal devices include a base defining a waste-receiving compartment and a lid pivotally connected to the base. When the lid is opened, a bag becomes visible and waste is inserted into an opening of the bag. The bag often passes through a membrane that requires force to insert the waste, and also serves to close the bag above the waste providing a barrier to waste and odor outflow. In some waste disposal devices, the bag is actually part of an accordion-folded length of flexible tubing that is housed in a cartridge.

Further, some of these waste disposal devices include a step or foot pedal assembly to complement or replace the manual opening and closing of the lid. The foot pedal assembly includes a depressible foot pedal and a spring, and is arranged to cause both opening of the lid when the foot pedal is depressed and closure of the lid when the pressing force is removed. The spring is moved against its bias upon depression of the foot pedal and returns to its original state when the pressing force is removed to thereby cause closure of the lid and rotation of the twisting mechanism.

OBJECTS AND SUMMARY OF THE INVENTION

An object of the invention is to provide a new and improved waste container.

Another object of the invention is to provide a new and improved bag securing, trapping or closing assembly or component for a waste container.

A waste container in accordance with the invention includes a base defining a waste-receiving compartment, an insert supported on the base and adapted to engage a peripheral edge of a bag that extends into the compartment while maintaining an opening of the bag unobstructed, the insert having at least one bag-engagement edge, and a movable closure component having a first engagement position in which the closure component engages with the insert to press the bag when present against the at least one bag-engagement edge of the insert, and a second non-engagement position in which the closure component is separated from the at least one bag-engagement edge of the insert. A lid is preferably attached to the base and movable between a first, closed position covering the opening of the bag and a second, open position in which it does not obstruct the opening of the bag.

The insert may include an inner wall, and as such, the bag that is draped over the inner wall and connected to the insert. In this case, the at least one bag-engagement edge consists of only one bag-engagement edge on a radially outward facing surface of the inner wall. The closure component is configured to engage with the insert to press the bag against only the one bag-engagement edge of the insert. The closure component may thus have an annular part having an "L"-shaped cross-section. The insert may further include an outer wall, a bottom wall extending between lower edge regions of the inner wall and the outer wall, and a support lip extending radially outward from an upper edge region of the outer wall. The insert is supported on the support by the support lip. The bag is attached to the radially outward facing surface of the inner wall.

The closure component may be attached to the base so that it would not be removable from the container when the insert is removed, or attached to the insert in which case it would be removed from the container when the insert is removed. In the latter case, the insert and closure component form a unit. In either case, the closure component may not be attached to the insert when in the non-engagement position.

The closure component may include structure to facilitate its lifting upward, e.g., a tab, in which case, a retainer may be arranged on the insert to engage with the tab and retain the tab in the engagement position.

The insert may include an inner wall, a ledge extending radially inward from an upper edge of the inner wall and an annular wall extending downward from an inner edge of the ledge. The closure component is attached to the insert and includes an annular portion having a U-shaped cross-section defining a channel, and is positioned in the engagement position such that the inner wall, the ledge and the annular wall are received in the channel to provide three bag-engagement surfaces. The inner wall of the insert may include detents on an outer surface.

To provide four bag-engagement surfaces, the closure component includes an extension portion that extends between the annular portion and an attachment location at which the closure component is attached to the base or to the insert. The extension portion has a lower edge or surface that presses a portion of the bag when present.

The insert may include an annular disc and a separate wall portion having an inner wall, a ledge extending radially inward from an upper edge of the inner wall and an annular wall extending downward from an inner edge of the ledge. The closure component includes an annular portion having a U-shaped cross-section defining a channel, and is positioned in the engagement position such that the inner wall, the ledge and the annular wall are received in the channel and three bag-engagement surfaces are provided. The wall portion optionally includes an attachment structure to attach the wall position to the annular disc.

In another embodiment, the insert includes a bottom wall, an outer wall extending upward from a radially outer edge of the bottom wall and an inner wall extending upward from a radially inner edge of the bottom wall. The inner wall has a larger height than the outer wall. An attachment structure attaches the closure component to the insert, and is arranged on the bottom wall.

In another embodiment, the insert includes an inner wall, a ledge extending radially inward from an upper edge of the inner wall and an annular wall extending downward from an inner edge of the ledge. The closure component includes an annular portion having a U-shaped cross-section defining a channel, and is positioned in the engagement position such that the inner wall, the ledge and the annular wall are received in the channel and three bag-engagement surfaces are provided. A gasket is optionally arranged in the channel to increase gripping of the bag when present. The gasket may be annular and arranged against a transverse wall of the annular portion defining a bottom of the channel.

In some embodiments, by grasping the tab and rotating the closure component, the bag is rotated to form a twist in or untwist in the bag.

Another embodiment of a waste container in accordance with the invention includes a base defining a waste-receiving compartment, and a bag support on the base and that includes an annular rim. The rim is adapted to engage a peripheral edge of a bag around an opening of the bag while maintaining the opening of the bag unobstructed with the bag extending into the compartment. The bag is not fixed to the bag support. A closure component selectively cooperates with the rim to press the bag when present against the bag support when the closure component cooperates with the rim such that the bag is fixed to the bag support only when the closure component cooperates with the bag support. An upper region of the bag is positionable around the rim and the bag is separable from the rim when the closure component does not cooperate with the bag support.

An embodiment of a bag trapping assembly for a waste container in accordance with the invention includes a first, supporting part including a disc portion defining an aperture that has a rim, and a bag passing through the aperture and having its open end above the disc portion and its sealed end below the disc. The open end of the bag overlies the rim. The bag is not fixed to the first part. A second, trapping part component selectively cooperates with the rim to press the bag against the rim when the second part cooperates with the rim such that the bag is fixed to the bag support only when the second part cooperates with the rim. An upper region of the bag is positionable around the rim and the bag is separable from the rim when the second part does not cooperate with the rim.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein:

FIG. 37 shows another embodiment of a waste container in accordance with the invention with a closure component in a non-engagement position;

FIG. 38 is a partial cross-section of FIG. 37;

FIG. 39 is a partial cross-section of FIG. 37 but showing the closure component in an engagement position;

FIG. 40 is a cross-section of the insert of FIG. 37;

FIG. 41 is a perspective view of an alternative embodiment of an insert for a waste container in accordance with the invention;

FIG. 42 is a perspective view of another embodiment of a waste container similar to that shown in FIG. 37 but with a different attachment of the closure component;

FIG. 45 is a perspective view of an alternative embodiment of an insert for a waste container in accordance with the invention shown with the closure component in a non-engagement position;

FIG. 46 is a perspective view of the embodiment shown in FIG. 46 with the closure component in an engagement position;

FIG. 47 is an exploded view of the insert of FIGS. 45 and 46:

FIG. 48 is a cross-section of the insert shown in FIG. 47;

FIG. 49 is a view of a bag securing assembly with a bag in accordance with the invention;

FIG. 50 is a view of the bag securing assembly shown in FIG. 49;

FIG. 51 is an exploded view of the bag securing assembly with a bag as shown in FIG. 49;

DETAILED DESCRIPTION OF THE INVENTION

Figure 1:
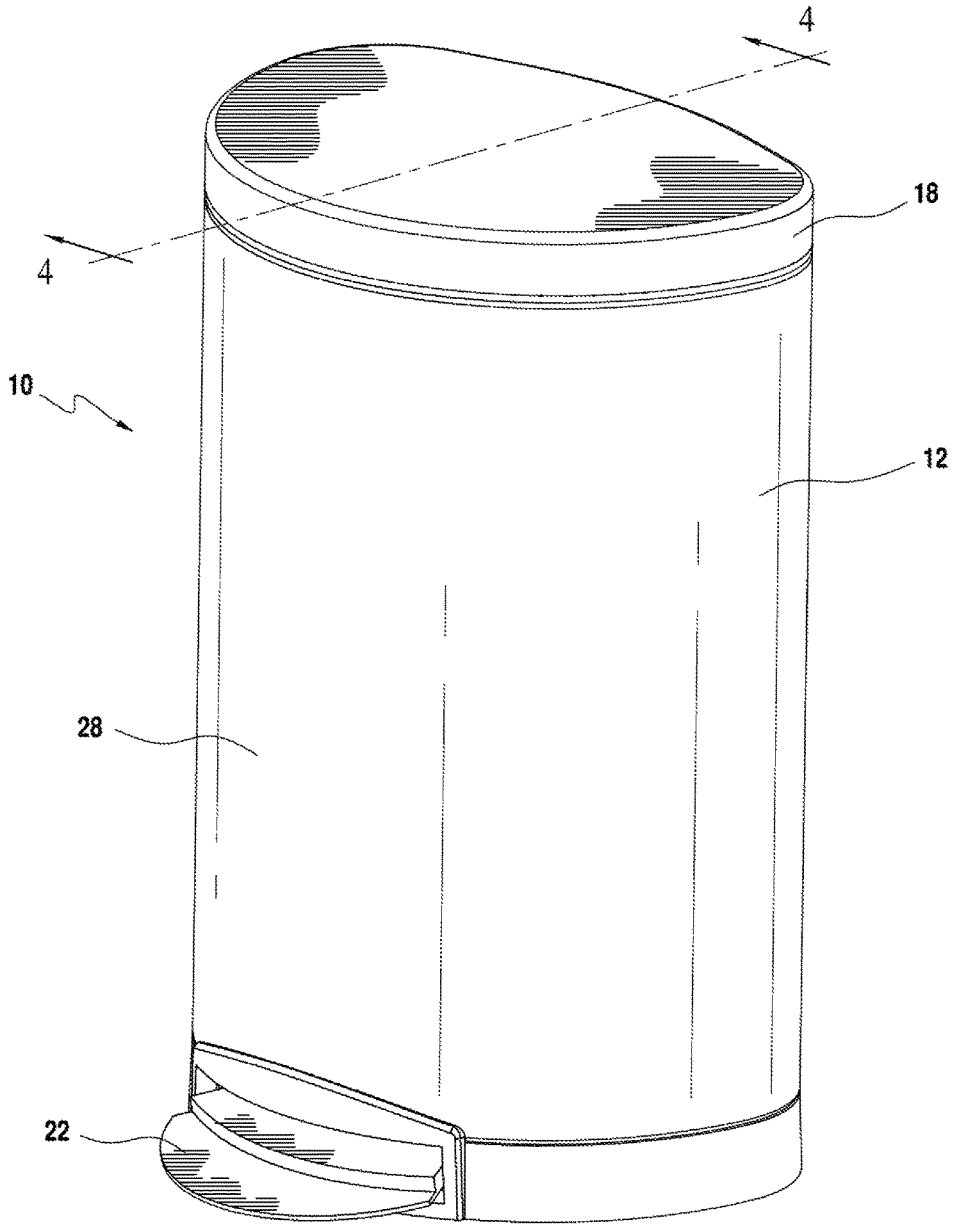
FIG. 1 is a perspective view of a first embodiment of a waste container in accordance with the invention shown with its lid in a closed state.

Referring to the accompanying drawings wherein like reference numerals refer to the same or similar elements, a first embodiment of a waste container in accordance with the invention is shown in FIGS. 1-6 and is designated generally as 10. Container 10 includes a base 12 defining a waste-receiving compartment 14 and an opening 16 communicating with the waste-receiving compartment 14 (see FIGS. 4 and 5). A lid 18 is movably attached to the base 12 and moves between a first position covering the opening 16, i.e., prevents insertion of waste into the waste-receiving compartment 14 (see FIG. 4) and a second position in which it does not obstruct the opening 16, i.e., enables insertion of waste (see FIG. 2).

The lid 18 may be pivotally mounted to a rear, upper edge of the base 12 by any type of pivotal mounting mechanism 20. Generally, the pivotal mounting mechanism 20 would include one or more parts on the base 12 and one or more cooperating parts on the lid 18. Instead of a pivotal mounting mechanism, another type of mechanism that enables the lid 18 to move while mounted to the base 12 between a closed position shown in FIG. 1 and an open position shown in FIG. 2 may be used in the invention, including any known to those skilled in the art of waste containers. Such a mechanism will be referred to herein as a lid mounting mechanism or lid mounting means.

Figure 2:
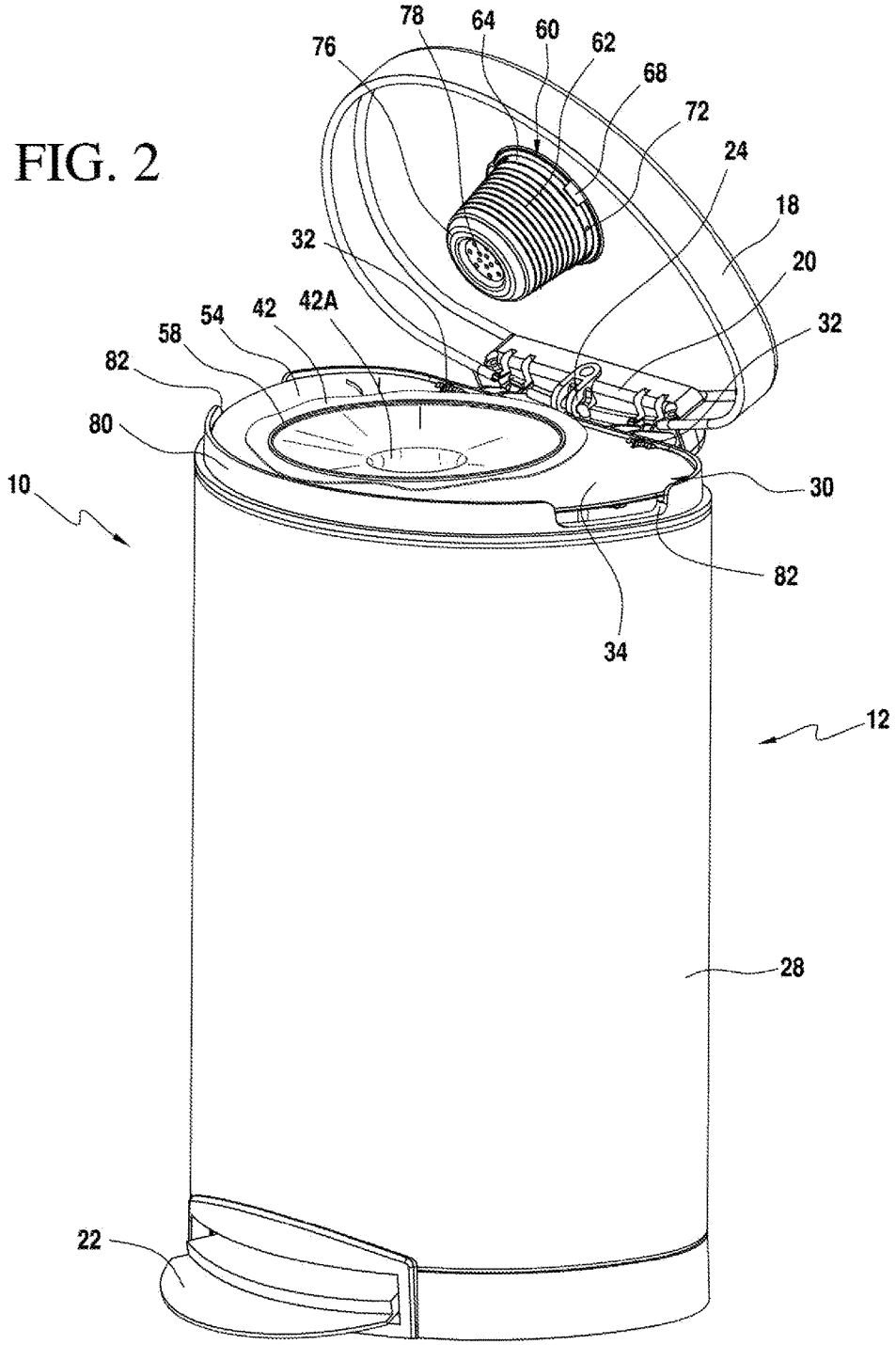
FIG. 2 is a perspective view of the waste container shown in FIG. 1 with its lid in an open and ready-for-use state.

Container 10 also includes a depressible pedal 22 that is coupled to the lid 18 and controls movement of the lid 18 between the closed position shown in FIG. 1 and the open position shown in FIG. 2. As shown, pedal 22 is a foot pedal having a first, undepressed state shown in FIG. 1 wherein it is slightly elevated from a plane defined by the lower surface of the base to enable depression thereof. When depressed into the state shown in FIG. 2, the coupling between the foot pedal 22 and the lid 18 causes the lid 18 to open. When pressure on the foot pedal 22 is released, the lid 18 closes. This coupling between the foot pedal 22 and the lid 18 to convert depression of the foot pedal 22 into opening movement of the lid 18 may be any coupling used in containers known to those skilled in the art. A portion of this coupling mechanism, also potentially referred to as coupling means herein, is shown at 24 in FIGS. 2 and 3, and includes a horizontal actuating member 26 shown in FIG. 4. The coupling mechanism may be as described in U.S. Pat. No. 8,393,489 (Stravitz), incorporated by reference herein.

Figure 3:
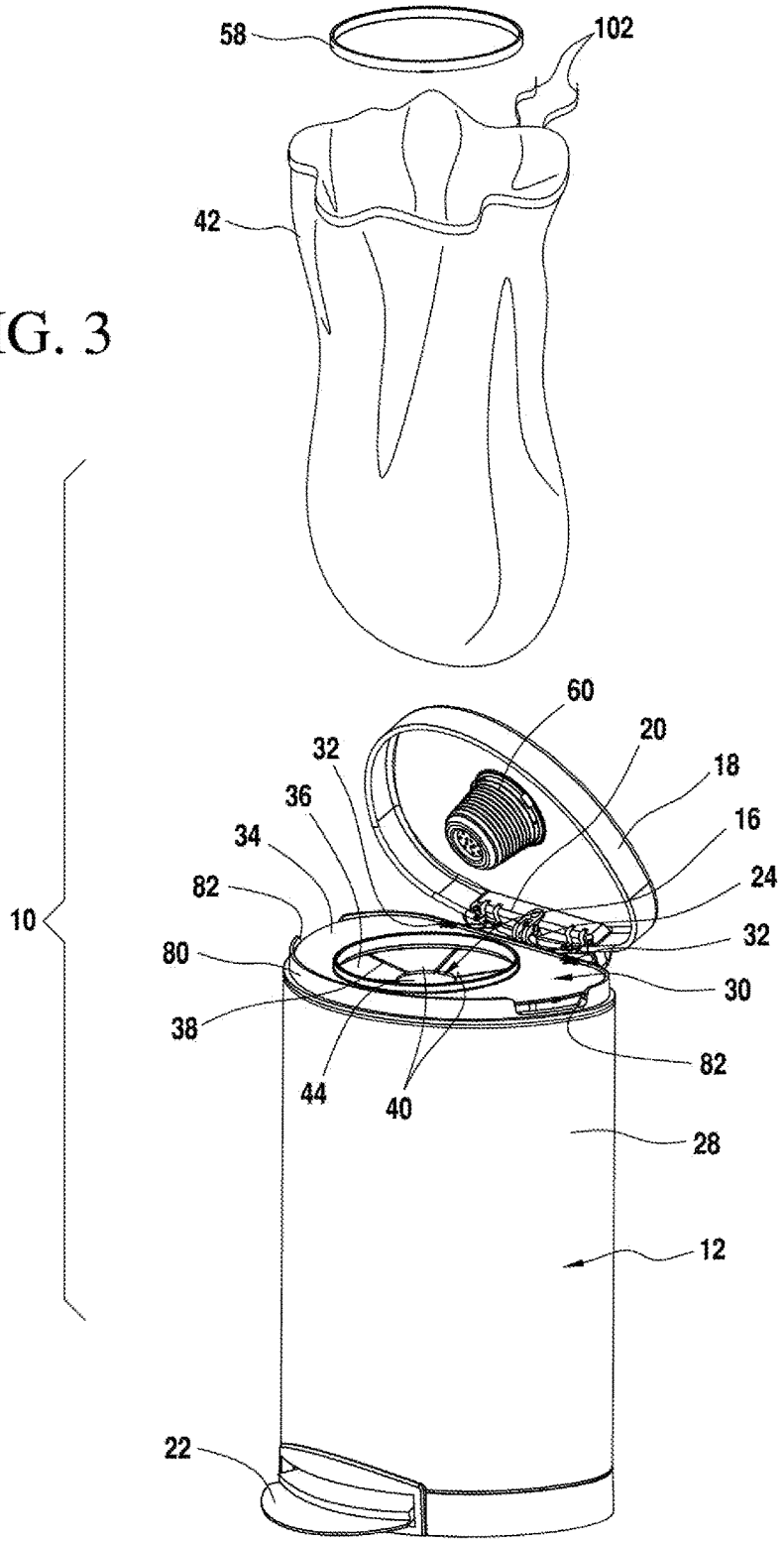
FIG. 3 is a perspective view of the waste container shown in FIG. 1 with its lid in an open state and a bag assembly separated from the container.
Figure 6:
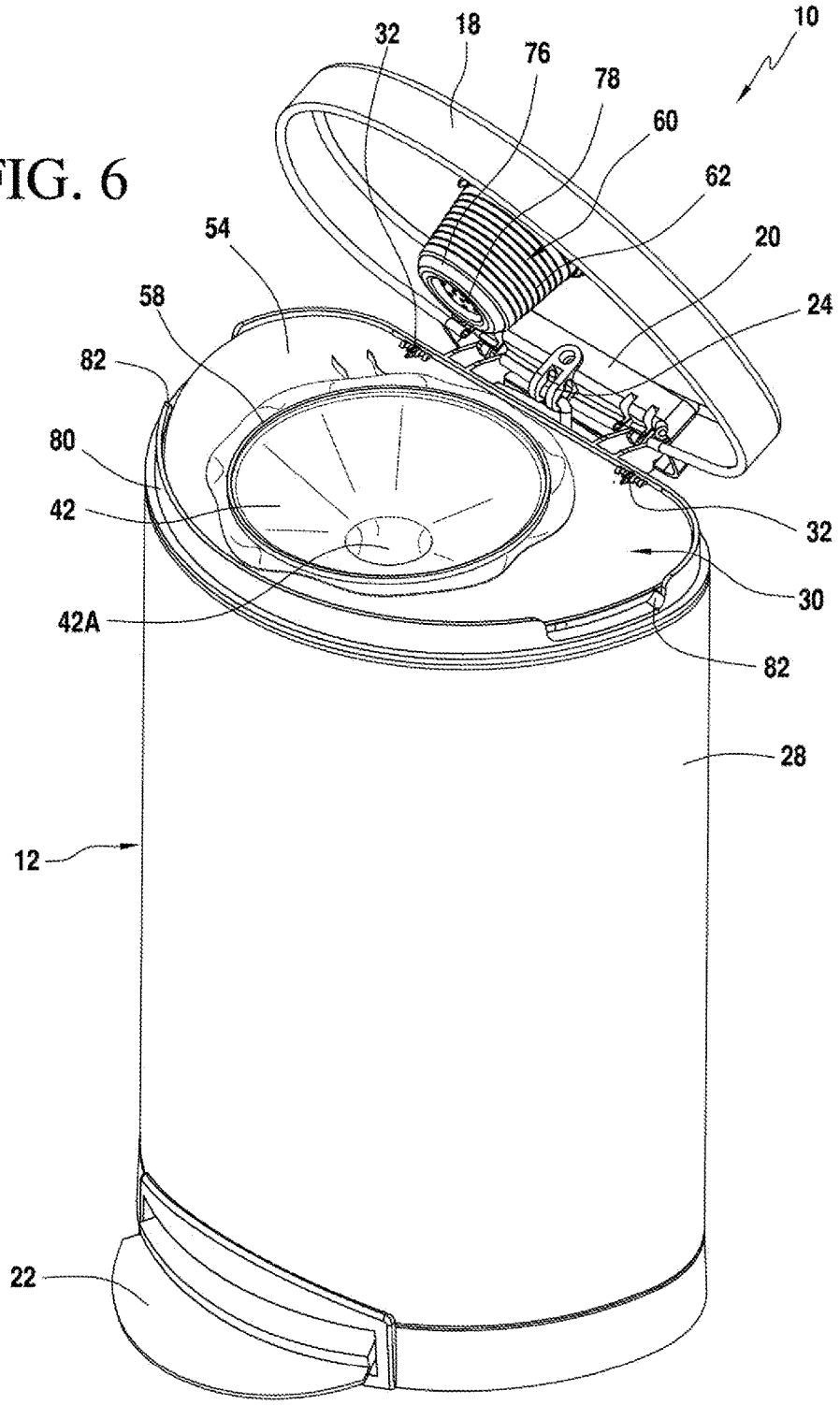
FIG. 6 is another perspective view of the container shown in FIG. 1.

Base 12 includes a body 28 and an upper compartment closure component, or closure component 30 pivotally attached to the body 28. To this end, a pivotal attachment mechanism or pivotal attachment means is arranged along a rear edge of the base 12 and includes one or more parts arranged on the closure component 30 and one or more complementary parts arranged on the body 20. For example, the pivotal attachment means may comprise two hinges 32 as shown in FIGS. 3 and 6, with one part of each hinge 32 being situated on or attached to the body 28 and the other, complementary part of each hinge 32 being situated on or attached to the closure component 30 to enable the closure component 30 to pivot about an axis substantially perpendicular to a vertical axis of the container 10. Other mechanisms and means that enable pivotal movement of one part relative to another may be used in the invention.

Closure component 30 includes a support portion 34 that generally has the same cross-sectional shape as the cross-sectional shape of the container 10 parallel to a surface on which the container 10 rests. Support portion 34 defines the opening 16 of the container 10. Closure component 30 also optionally includes or retains a membrane 36 that is situated in the opening 16 and may be releasably or permanently attached to the support portion 34.

Figure 26:
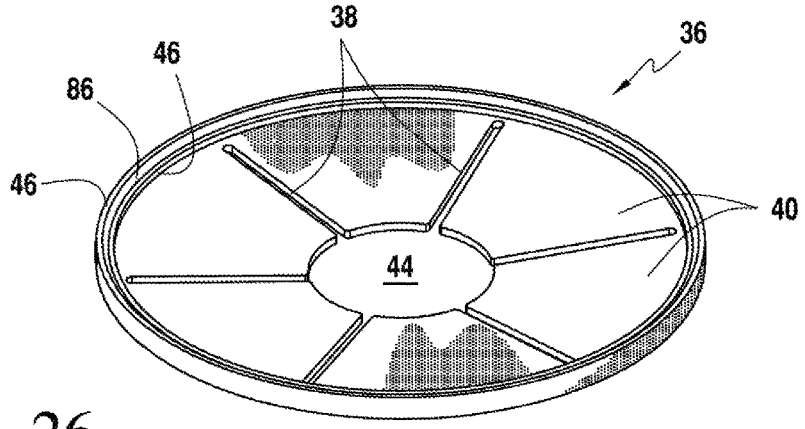
FIGS. 26-28 shows various membranes used with the waste containers in accordance with the invention.

Membrane 36 includes a plurality of slots 38 between fingers 40 of the membrane 36, and specifically six slots 38 (see FIGS. 3 and 26). The slots 38 provide the membrane 36 with flexibility to enable insertion of waste into a bag 42 that overlies the membrane 36 with a portion of the bag 42 being passed through a central opening 44 of the membrane 36.

More specifically, the bag 42 overlies the membrane 36 to define a bag aperture 42A which forms at the central opening 44 of the membrane 36 (see FIG. 2). This bag aperture 42A is exposed when the lid 18 is pivoted upward relative to the base 12, e.g., by depressing the foot pedal 22 (see FIG. 6). The bag aperture 42A is covered when the lid 18 is closed, i.e., upon releasing pressure on the foot pedal 22, and may also be closed by means of a waste treatment component 60 or 110, described more fully below, when such a waste treatment component is present.

The membrane 36 may be formed and constructed in different ways and is not limited to the presence of six fingers 40 separated by six slots 38 as in the illustrated embodiment (see FIG. 26). The material of the fingers 40 may be selected to be flexible so that they flex downward in a direction away from the center when a person pushes waste through the central region of the membrane 36. The material of the fingers 40 should also be resilient so that the fingers 40 return to their initial form after the person has removed their hand from engagement with the membrane 36, or the inserted waste has been pushed downward through the membrane 36 and is no longer in engagement therewith.

For example, the membrane 36 may be made of silicone or another rubbery material. It may also be made of a flexible synthetic material which flexes under pressure and returns when pressure is removed. The edges of the fingers 40 which are expected to engage the bag 42 may be provided with a friction-enhancing material to increase the contact force between the fingers 40 and the bag 42.

Furthermore, the membrane 36 is preferably molded in a resilient substrate that can be adjusted for proper rigidity depending on the application. Polypropylene is one such material. The membrane 36 can also be reinforced with some ribbing to give it strength to return substantially to its relaxed shape. The membrane opening 44, 44A and 44B of membranes 36, 36A and 36B, respectively, shown in FIGS. 26-28 may have smaller apertures for specific applications, for example, when not using the waste treatment component 60, 110 to seal off the bag opening 42A that aligns with the membrane opening 44, 44A, 44B.

Membrane 36 may be formed integral with the support portion 34 to provide a unitary closure component 30 or separate therefrom and then attached thereto. For example, as shown in FIGS. 4 and 5, the membrane 36 includes an upwardly facing channel 86 defined between two walls 46 (see also, FIGS. 26-28) and the support portion 34 includes two support walls 48 separated by a channel 50 (see also, FIG. 14), all of which are dimensioned such that one wall 46 of the membrane 36 securely fits into the channel 50 of the support portion 34 and one wall 48 of the support portion 34 securely fits into the channel 44 of the membrane 36.

Figure 4:
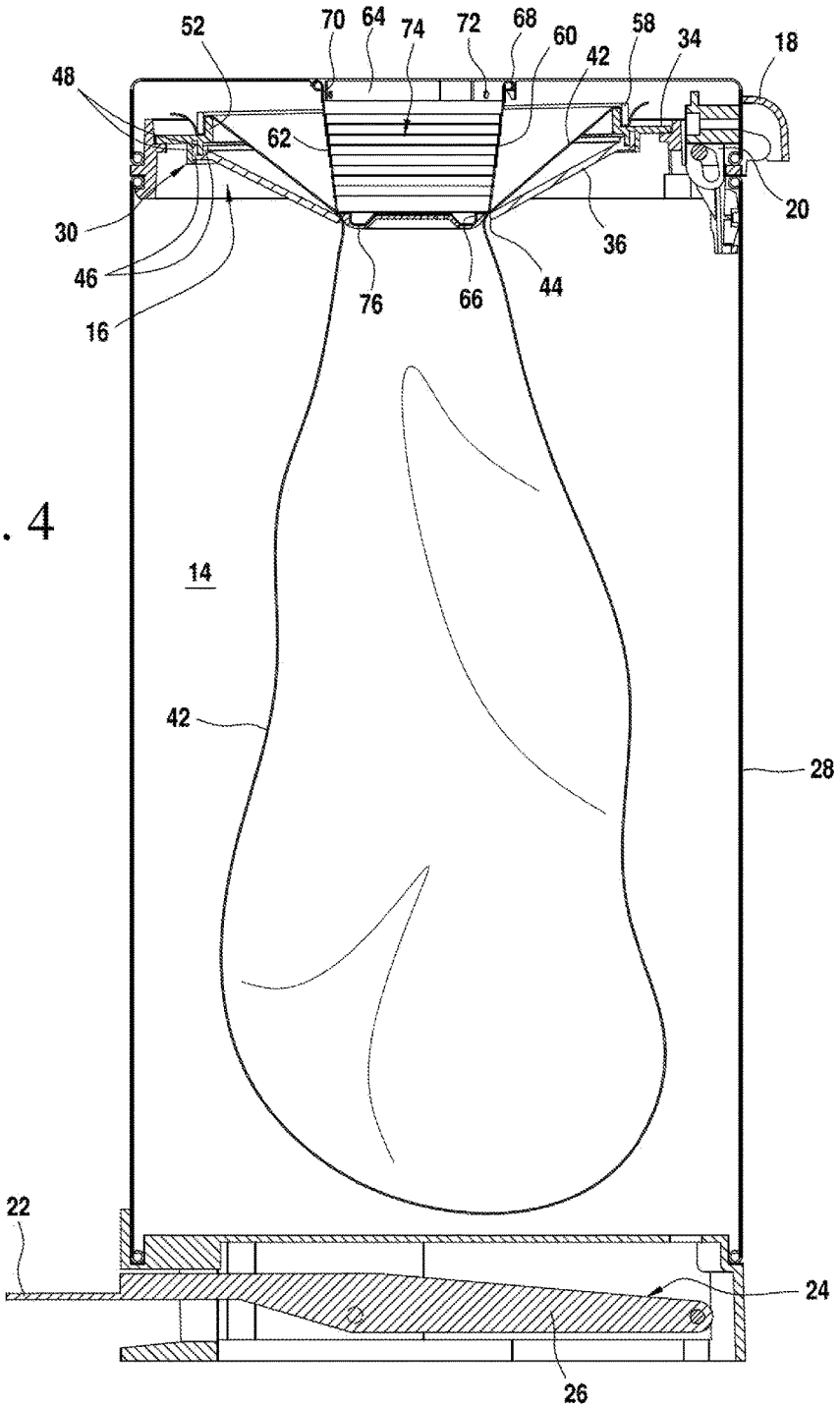
FIG. 4 is a cross-sectional view of the container shown in FIG. 1 taken along the line 4-4- in FIG. 1.
Figure 5:
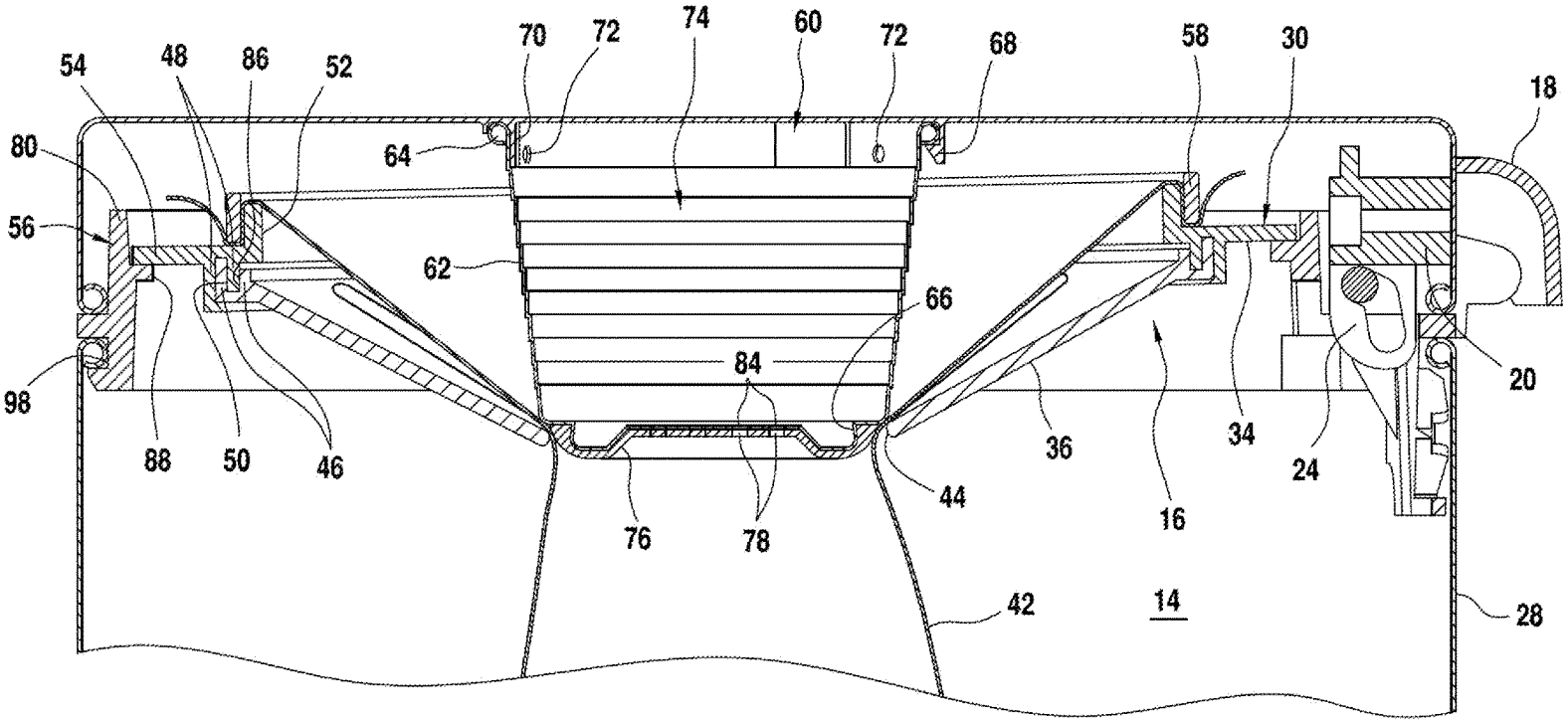
FIG. 5 is an enlarged view of the upper portion of FIG. 4.

The support portion 34 also includes a wall 52 that projects from a planar portion 54 and over which the bag 42 is placed (see FIGS. 4 and 5).

The body 28 of the base 12 includes a closure component support portion 56 that includes an inwardly projecting lip 88 on which a peripheral edge of the planar portion 54 of the support portion 34 rests when the closure component 30 is in its use position (shown in FIGS. 4 and 5). Closure component support portion 56 may be formed integral with a remaining portion of the body 28 or separate therefrom and then attached thereto. In the latter case, the closure component support portion 56 may be formed with a channel 98 that receives a rim at the upper edge of the remaining portion of the body 28 (see FIG. 5). Also, closure component support portion 56 includes a peripheral wall 80 that has one or more cut-out portions 82 (see FIGS. 2 and 3). The purpose of the cut-out portion(s) 82 is to facilitate lifting of the support portion 34, causing it to pivot relative to the body 28 of the base 12 and thereby enable access to a bag of waste in the compartment 14.

Another element of the container 10 is a hoop 58 that secures the bag 42 to the closure component 30. Hoop 58 has the same shape as the projecting wall 52 of the support portion 34 of the closure component 30 and is dimensioned relative thereto, i.e., with its inner circumference slightly larger than the outer circumference of the projecting wall 52, to provide a tight fit of the bag 42 therebetween (see FIGS. 4 and 5). This tight fit secures the bag 42 to the container 10 and should prevent unintentional release of the bag 42 from engagement with the container 10. The hoop 58 may be retained when not in use on the underside of the lid 18, e.g., by providing a securing or attachment mechanism such as clamps, on the underside of the lid 18. This should prevent loss of the hoop 58, yet ensure that the hoop 58 is readily available when it is desired to use it (note that the waste container 58 may be used with or without the hoop 58). As an alternative, the hoop 58 may be attached to the closure component 30, as described below with reference to FIG. 30.

Container 10 also includes a waste treatment component 60 that is positioned on the underside of the lid 18 (see FIGS. 2-6 and 23). Waste treatment component 60 includes a base 62 having an attachment portion 64 at an upper end and a conduit portion 66 at a lower end (see FIGS. 5 and 23). Attachment portion 64 may comprise an enlarged rim that is designed to be positioned between projections 68, 70 on the underside of the lid 18. Projections 68 are designed to be positioned radially outward of the attachment portion 64 (as shown in FIG. 2) and projections 70 are designed to be positioned radially inward of the attachment portion 64 (as shown in FIG. 5), when the attachment portion 64 is engaged with the lid 18. In this manner, the attachment portion 64 is snapped onto the lid 18, although other mechanisms and means for removably securing the base 62 to the lid 18 are encompassed within the scope of the invention. Projections 68, 70 are flexible and each includes a ramped portion that facilitates insertion of the waste treatment component 60 into engagement with the projections 68, 70. Removal of the waste treatment component 60 from the lid 18 involves flexing one or more of the projections 68 outward and pulling the waste treatment component 60 away from the lid 18.

Also, attachment portion 64 includes apertures 72 that are preferably equal in number to the projections 68 and have the same circumferential spacing as the projections 68. In this manner, the waste treatment component 60 may be rotated to a position in which the projections 68 cover the apertures 72, and thereby prevent release of deodorant, air freshener, air purifier, or disinfectant from an interior cavity 74 of the waste treatment component 60 to the space between the bag 42 and the lid 18, or allow for release of deodorant or disinfectant from the interior cavity 74 of the waste treatment component 60 to the space between the bag 42 and the lid 18. Rotation of the waste treatment component 60 can be effected manually depending on whether the user of the container 10 determines that there is a need to address unpleasant smells and odors between the bag 42 and the lid 18 or disinfect this area. Rotation of waste treatment component 60 therefore controls the degree to which deodorant or disinfectant is released into the space between the lid 18 and bag 42.

The base 62 tapers in a downward direction toward the bottom of the base 12 of the container 10, and preferably is provided with a vertical height such that is slightly presses against the bag 42 at a location at or around where the bag 42 contacts the membrane 36 (see FIGS. 4 and 5). The outer surface of the base 62 has staggered edges that assist in scraping clean bag 42 when the lid 18 is closed. The outer surface of the base 62 may be provided with a smooth tapering edge, or any other form or type of edge instead of the staggered edge. Otherwise, the base 62 is preferably formed such that when the lid 18 is closed, it forms a seal against the bag 42 around the bag opening 42A. Thus, the base 62 has a peripheral wall extending from a lower wall around the periphery of the lower wall.

In a preferred embodiment, the waste treatment component 60 is dimensioned so that when the lid 18 is closed, the waste treatment component 60 presses the membrane 36 slightly inward causing it to flex. This flexure serves to provide a seal to the bag 42, i.e., that portion of the bag 42 containing waste in the compartment 14 is sealed by the pressure contact between the membrane 36 and the waste treatment component 60. One of the seal's purposes is to minimize or prevent the backdraft of odor, airborne bacteria and/or fungus from escaping the waste contained inside the waste containing bag 42.

The waste treatment component 60 may house one or more of a deodorant, a disinfectant, an air freshener, an air purifier, a compound that neutralizes odor, a compound that neutralizes bacteria, and a compound that neutralizes fungus. These compounds may be solid, liquid or in powder form.

Figure 23:
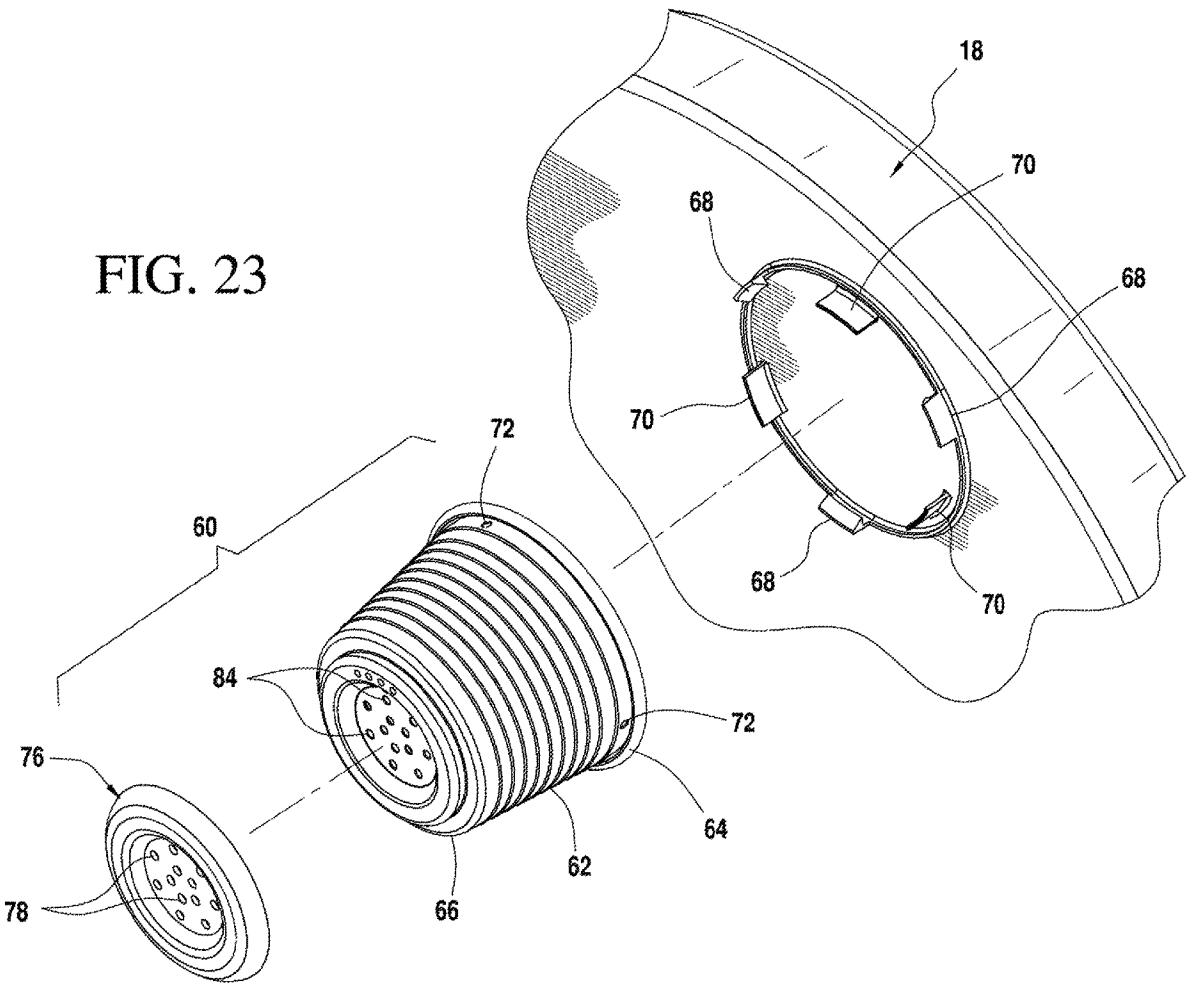
FIG. 23 is an exploded perspective view of a first embodiment of a waste treatment component used with a container in accordance with the invention.

Conduit portion 66 is formed as the bottom of the base 62 and includes a plurality of apertures 84 through which deodorant or disinfectant from the interior cavity 74 of the waste treatment component 60 is released to the interior of the bag 42 (see FIG. 23). Apertures 84 are formed in the lower wall of the base 62. However, this release is again controlled by the user by attaching a rotatable member 76 to the base 62 to selectively cover or expose the apertures 84 (see FIG. 23). This attachment may be a snap-on type of attachment, or similar. Rotatable member 76 includes apertures 78 that either align with apertures 84 on the conduit portion 66 or solid portions of the conduit portion 66 (see FIG. 5 whereon two apertures 84 align with two respective apertures 66 while other aperture 84 align with a solid portion of the conduit portion 66). Rotation of member 76 therefore controls the degree to which deodorant or disinfectant is released into the bag 42.

Member 76 may be positioned to facilitate pushing of waste through the central opening 44 of the membrane. To this end, the waste treatment component mounting mechanism, i.e., projections 68, 70, are preferably positioned to align the member 76 with the central opening 44 of the membrane 36. Thus, during use of the container 10, any waste that is lodged in the bag 42 around the central opening 44 of the membrane 36 should be pushed by waste treatment component 36 into the portion of the bag 42 in the compartment 14 when the lid 18 is closed. In addition or alternatively, the member 76 will abut against the bag 42 around the opening 42A and seal the bag opening 42A, i.e., at least partly press against and/or make contact with the bag 42. The waste treatment component 60 therefore performs bag sealing, waste insertion and waste treatment.

Instead of a removal mounting mechanism for the waste treatment component 60, a waste treatment component may be permanently attached to the underside of the lid 18. It could thus be formed integral with the lid 18 and configured to allow for insertion of a new deodorant, disinfectant, etc., e.g., with a removable cartridge, access door, and the like.

Different constructions of a waste treatment component 60 are envisioned. In one embodiment, the waste treatment component 60 is a disposable, single-use deodorizer and/or disinfectant and must be replaced by a completely new deodorizer and/or disinfectant once the deodorant and/or disinfectant in the interior cavity 74 is used up. In another embodiment, the waste treatment component 60 is designed for multiple uses and allows for insertion of blocks or pellets of deodorant or disinfectant into the interior cavity 74 upon disengagement of the waste treatment component 60 from the lid 18.

Waste treatment component 60 may also be considered a canister. The canister may be made with two interior cavities, one including a disinfectant and one including a deodorant. The cavity including the disinfectant may communicate with the apertures 72 in the attachment portion 64. The cavity including the deodorant may communication with the apertures 84 in the conduit portion 66.

In use, the container 10 is placed into a use state by obtaining a bag 42, lifting the lid 18 into the state shown in FIG. 3, pushing the bag 42 through the central opening 44 of the membrane 36 into the compartment 14 and placing the upper flange of the bag 42 over the projecting wall 52 of the support portion 34 of the closure component 30. Then, the hoop 58 is placed around the projecting wall 52 to sandwich part of the bag 42 between the hoop 58 and the projecting wall 52 (providing the container 10 with the state shown in FIG. 2). The bag 42 may optionally be tied at its open end by ties or a drawstring 102 (see FIG. 3), although such tying may usually occur when the full bag 42 is removed from the container 10. The container 10 is ready for use.

For use, the lid 18 is opened by depressing the foot pedal 22 and waste is then pressed against the bag 42 in that portion overlying the membrane 36 until the waste is pressed past the membrane 36 into the compartment 14 (see FIG. 4 in which the bag 42 in the compartment 14 may contain one or more waste insertions). The lid 18 is then closed, e.g., by releasing pressure on the foot pedal 22. As desired, the rotatable member 76 and base 62 are manipulated to cause release of deodorant or disinfectant from the interior cavity 74 of the waste treatment component 60 into the bag 42 and/or into the space between the bag 42 and the lid 18.

Figure 22:
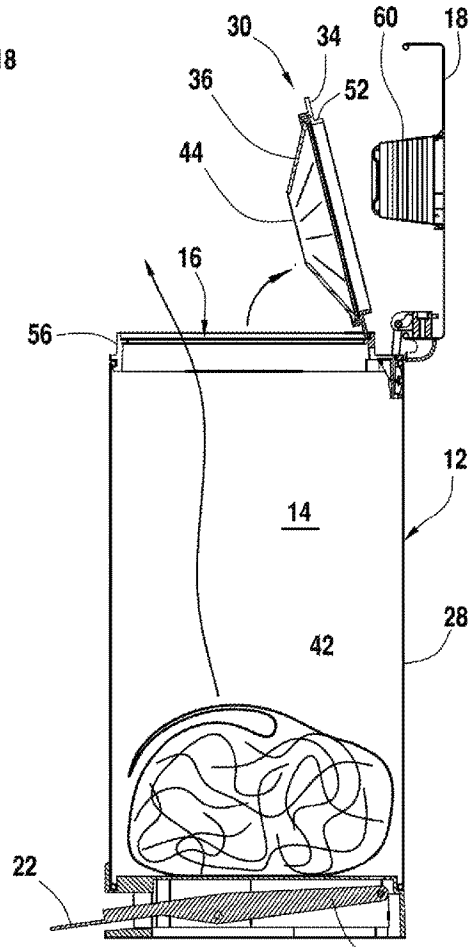
FIGS. 20-22 show different stages in use of the waste container shown in FIG. 1 including stage during removal of a bag from the container.
Figure 21:
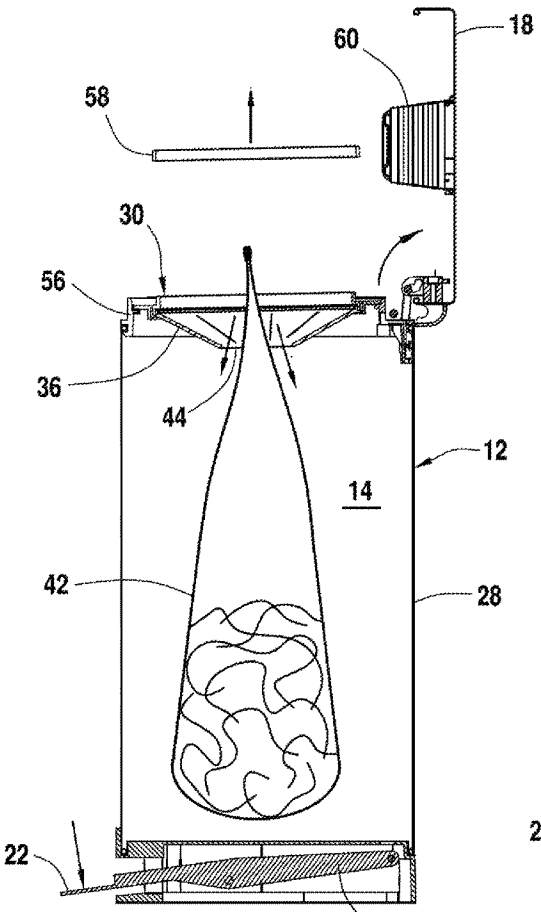
Figure 20:
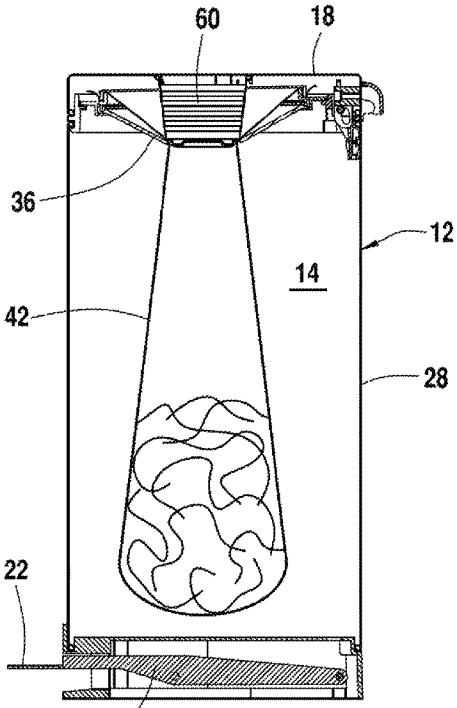

Referring now to FIGS. 20-22, when the bag 42 is full and it is desired to remove the bag 42 from the container 10 (as shown in FIG. 20), the lid 18 is lifted up by depressing the foot pedal 22, the hoop 58 is lifted up (FIG. 21) and the flange of the bag 42 inserted through the central opening 44 of the membrane 36 (see the arrows in FIG. 21 which represent this movement). The closure component 30 is lifted up (see FIG. 22) and then the flange of the bag 42 is tied or otherwise closed, e.g., with a drawstring or a bag tie known to those skilled in the art. Alternatively, the flange of the bag 42 is tied or otherwise closed before the closure component 30 is lifted up (in the position shown in FIG. 21). The full bag 42 is then lifted out of the compartment 14 (see FIG. 22) and the closure component 30 then moved back into engagement with the base 12 and readied for insertion of a new bag 42.

Figure 7:
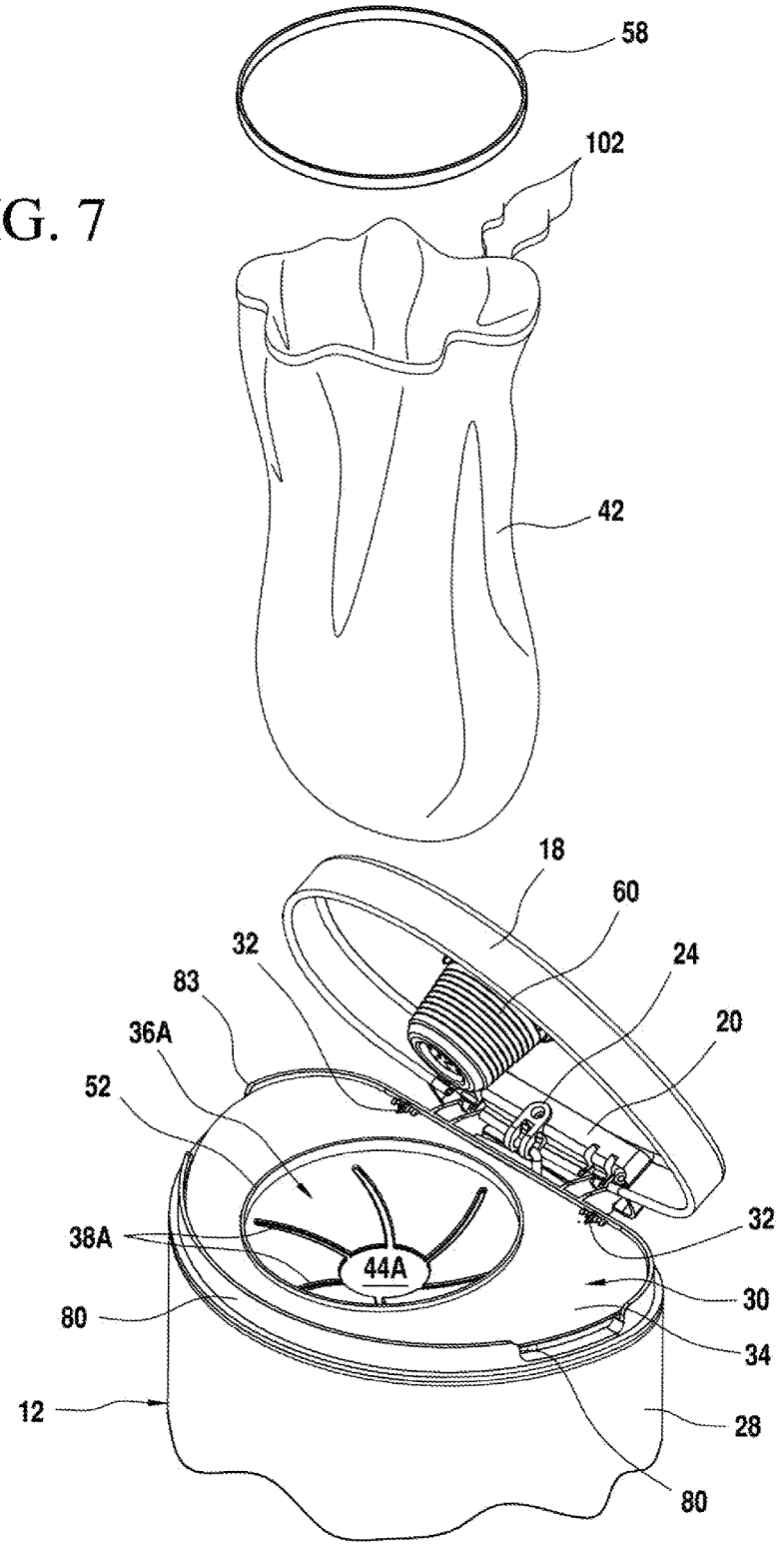
FIG. 7 is a perspective view of another embodiment of a waste container including a different membrane than that shown in FIG. 3.
Figure 8:
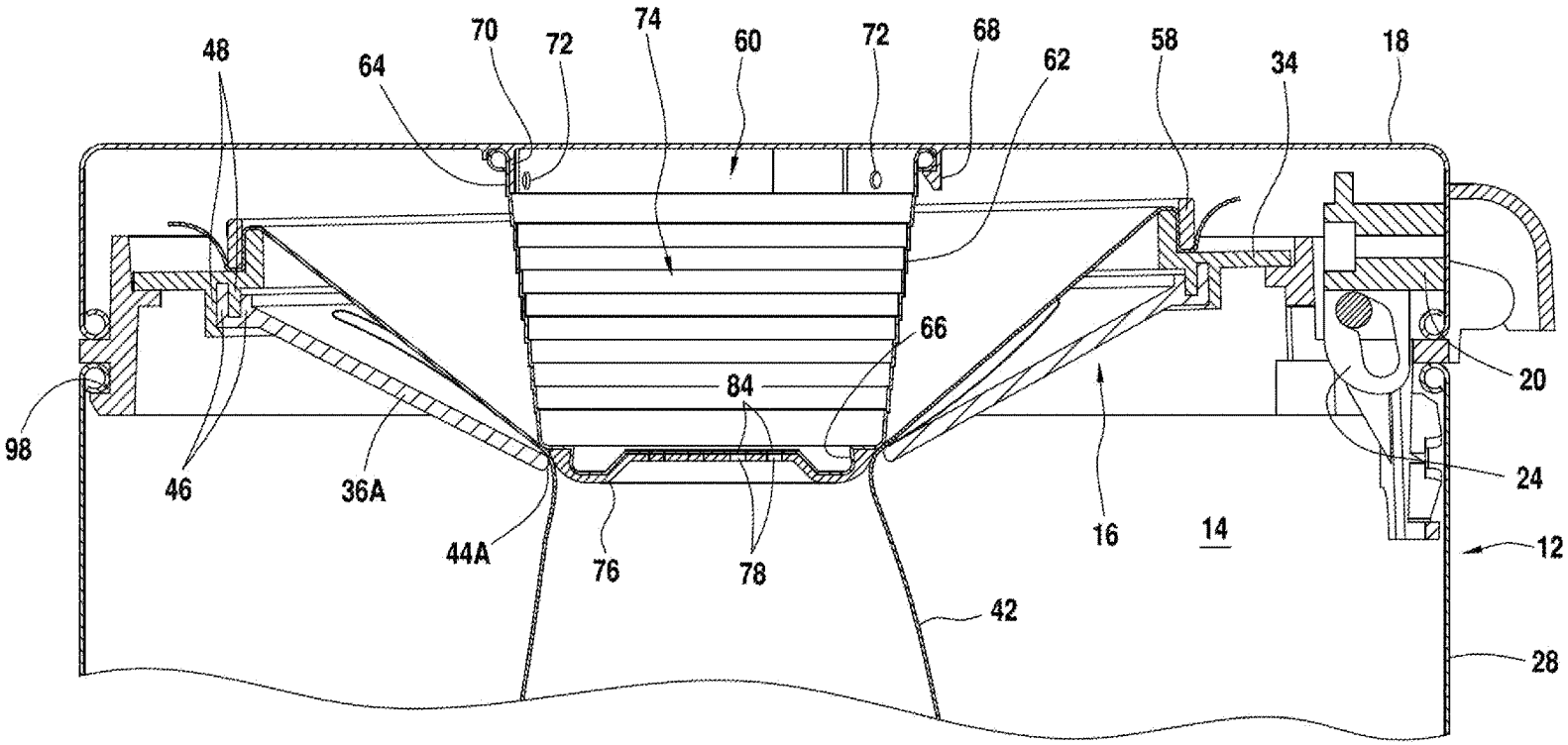
FIG. 8 is a cross-sectional view of a portion of the container shown in FIG. 7.
Figure 27:
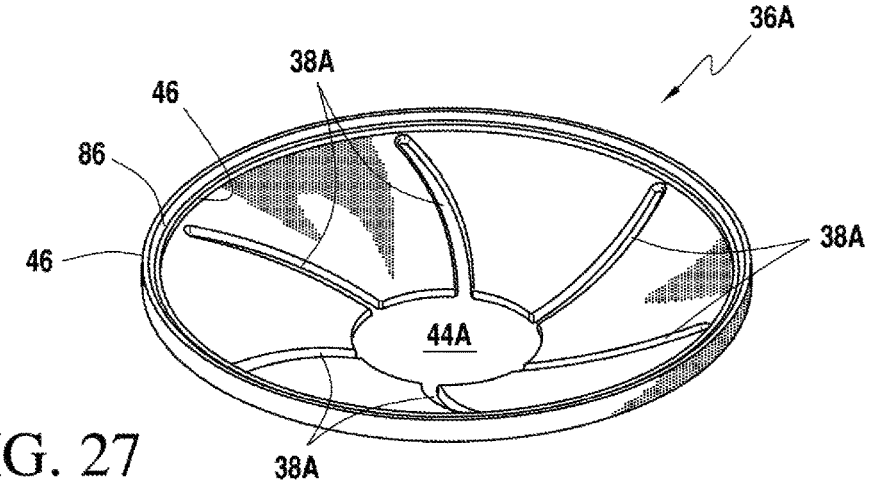

FIGS. 7 and 8 show another embodiment of container 10 with a different membrane 36A (also shown in FIG. 27). Membrane 36A has six curved slots 38A leading from the central opening 44A. Otherwise, the container with membrane 36A is used in the same manner as container 10 and membrane 36A may have the same characteristic and properties as membrane 36.

Figure 9:
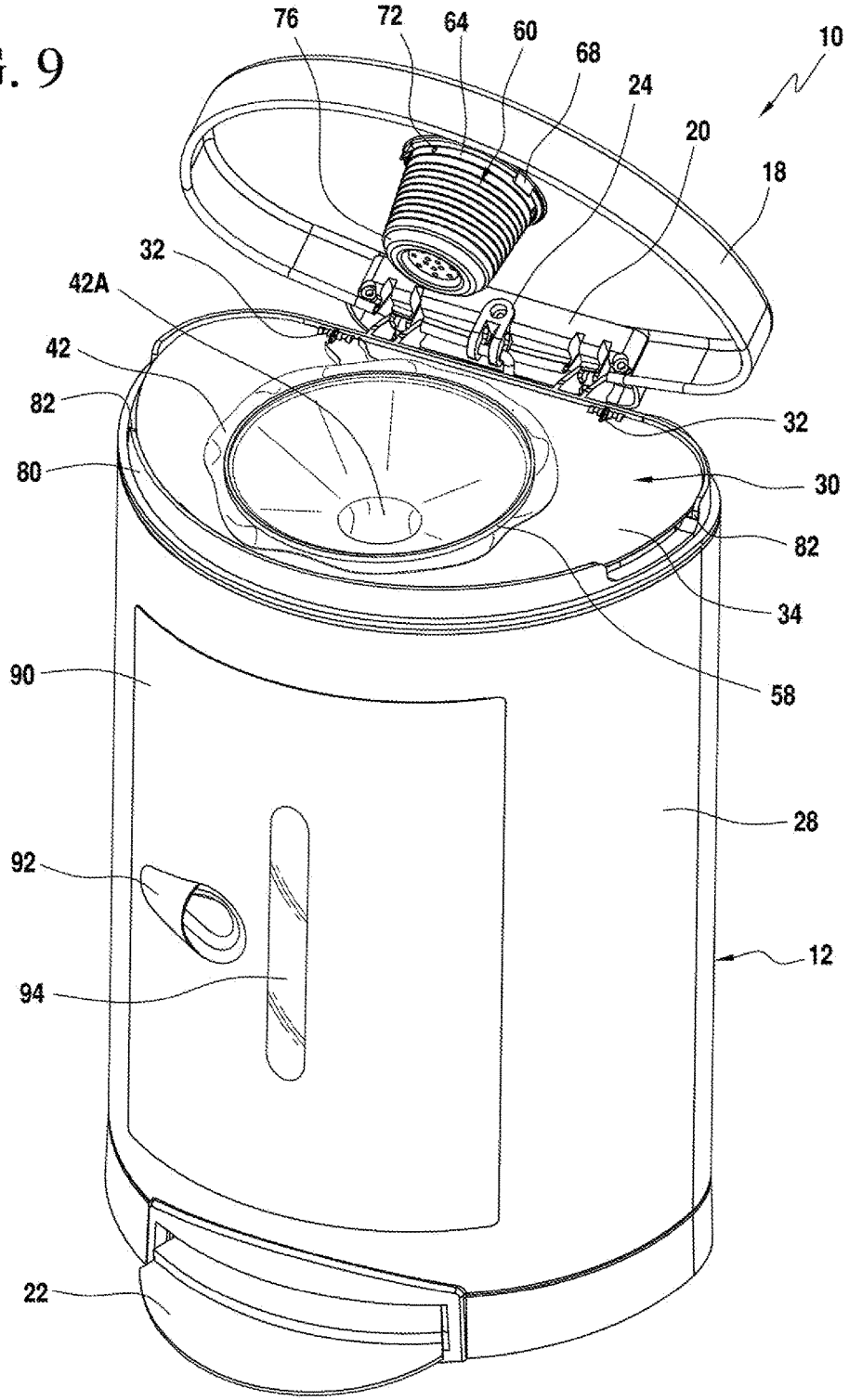
FIG. 9 is a perspective view of another embodiment of a waste container in accordance with the invention.
Figure 10:
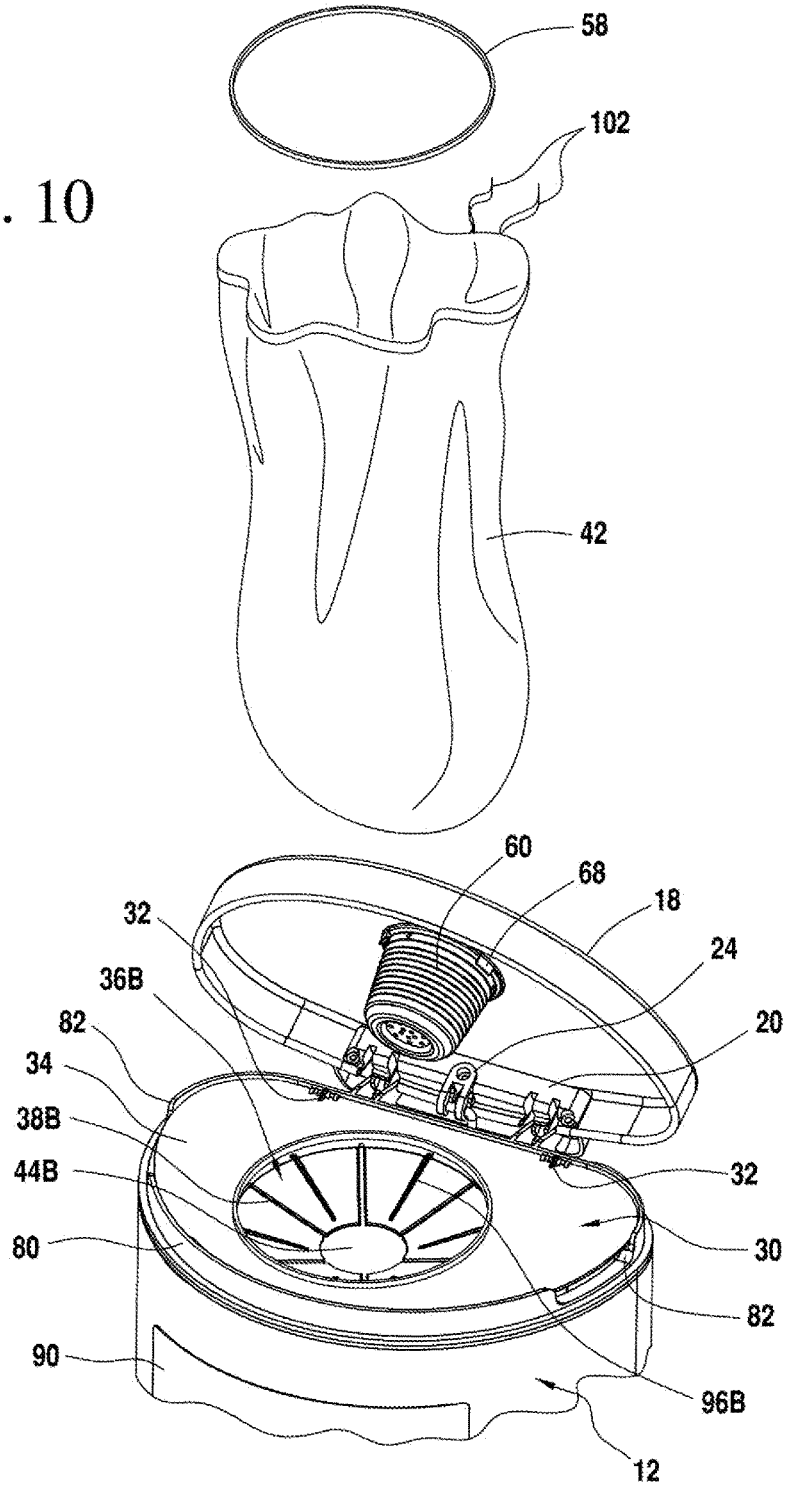
FIG. 10 is a perspective view of the container shown in FIG. 9 with the bag and hoop removed therefrom.
Figure 11:
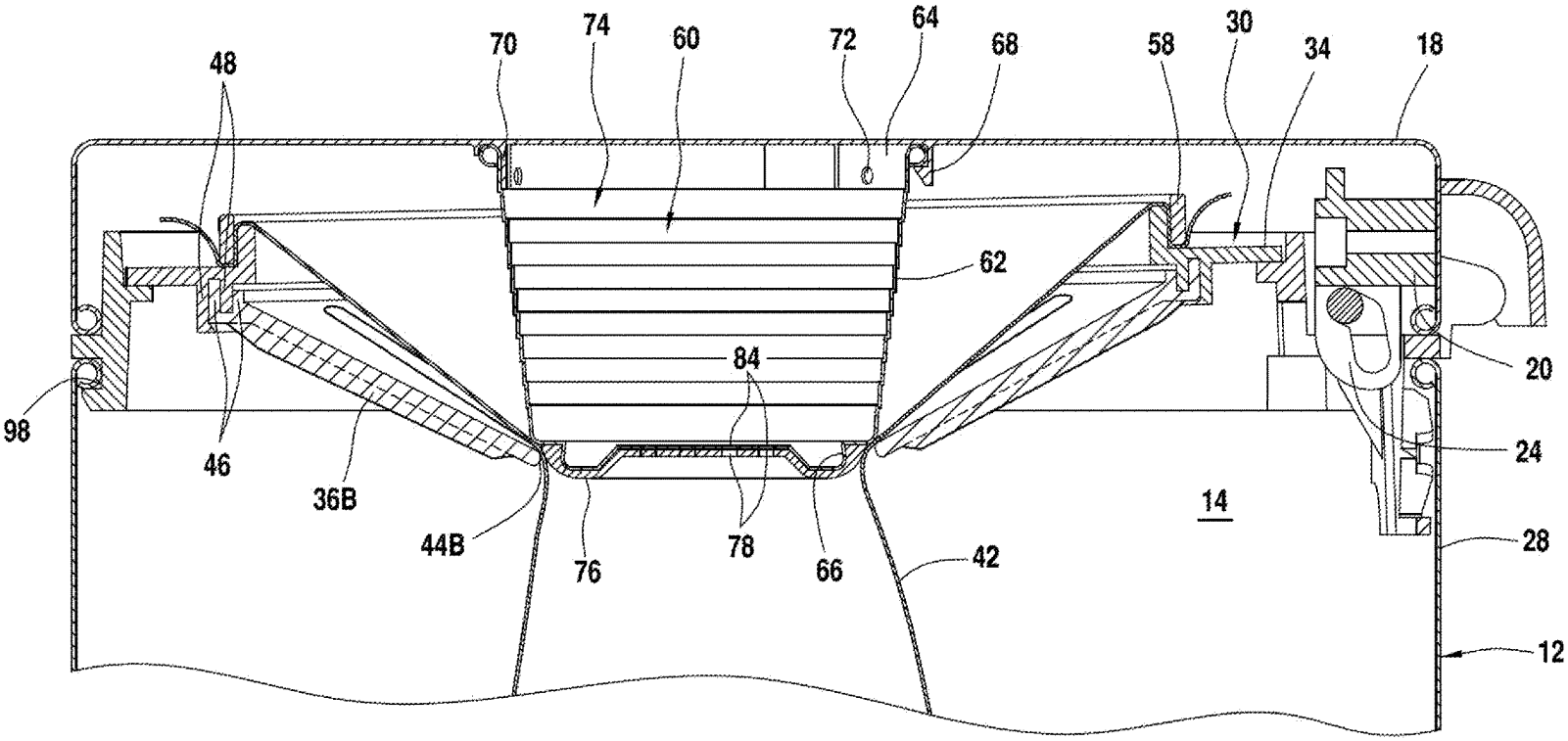
FIG. 11 is a cross-sectional view of a portion of the container shown in FIG. 9.

FIGS. 9-11 show another embodiment of container 10 wherein a door 90 is formed in the body 28 of the base 12.

Door 90 is provided with a conventional attachment mechanism to enable it to be opened by pulling on a handle 92 and closed as desired, e.g., one or more hinges situated on the interior of the container 10. Door 90 also includes a window 94 that preferably extends vertically as shown to enable easy viewing of the condition of the bag 42 in the compartment 14 vis-à-vis its state of fullness. The window 94 is made of a clear or transparent material, e.g., plastic. By providing the window 94, a user has the option to view whether the bag 42 is full or not and based thereon, determine when it is appropriate to remove the bag 42 and replace it with a new bag 42.

Figure 28:
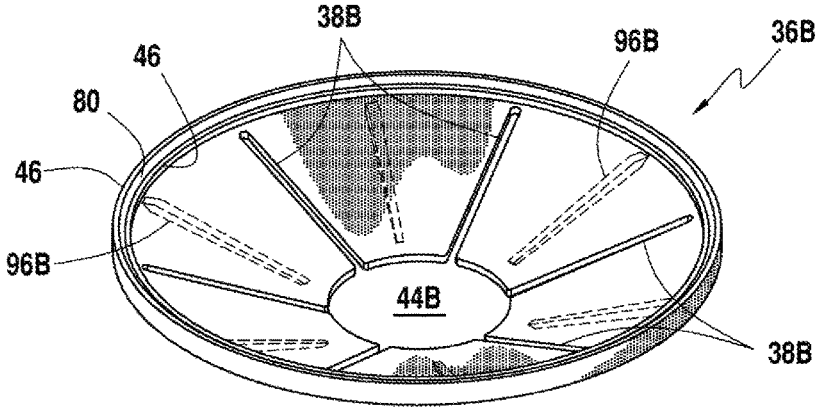
Figure 29:
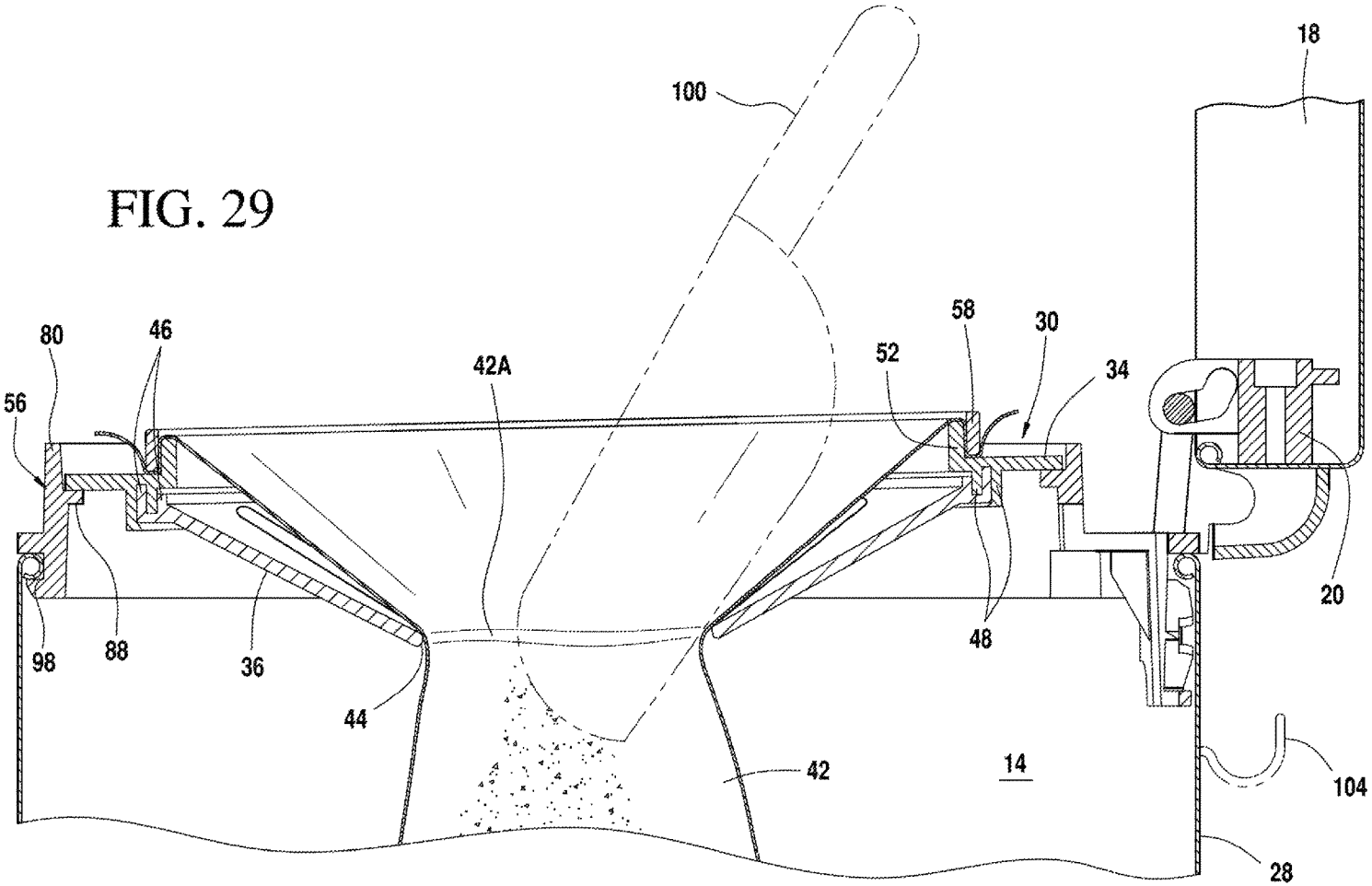
FIG. 29 is a view showing use of a container with a scoop that may be used to scoop cat litter into the bag.

The container shown in FIGS. 9-11 also includes a membrane 36B differing from membranes 36 and 36A (see also FIG. 28). Membrane 36B has slots 38B that extend from the central opening 44B to almost the periphery of the membrane 36B and also supplemental slots 96B that extend radially inward from the periphery of the membrane 36B close to but separated from the central opening 44B. Supplemental slots 96B provide the membrane 36B with additional flexibility. Also, supplemental slots 96B may not extend fully through the thickness of the membrane 36B, i.e., have a height less than the height of the membrane 36B.

Otherwise, the container with membrane 36B is used in the same manner as container 10 with either of membranes 36, 36A, and membrane 36B may have the same characteristic and properties as membrane 36.

Figure 12:
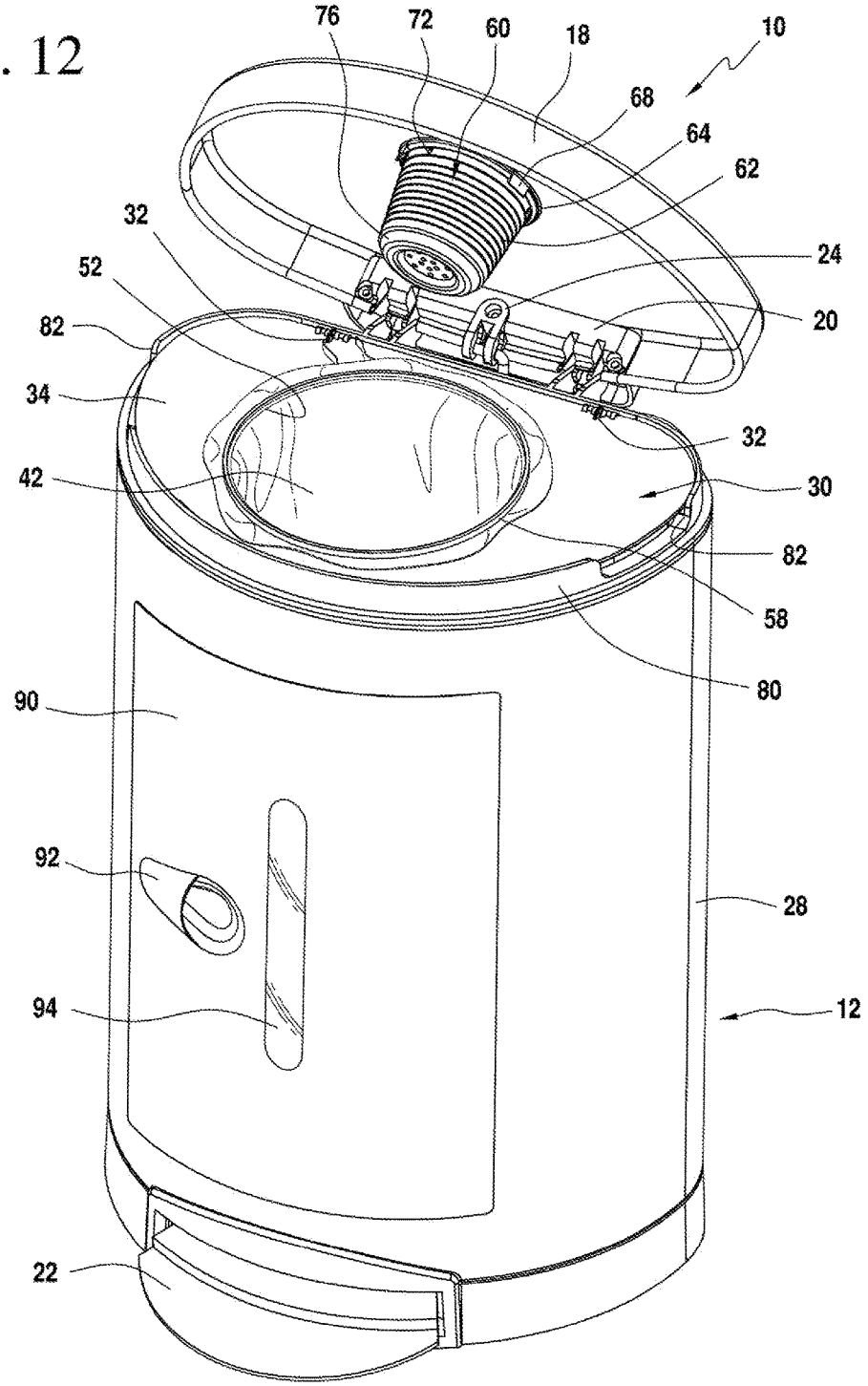
FIG. 12 is a perspective view of another embodiment of a waste container in accordance with the invention.
Figure 13:
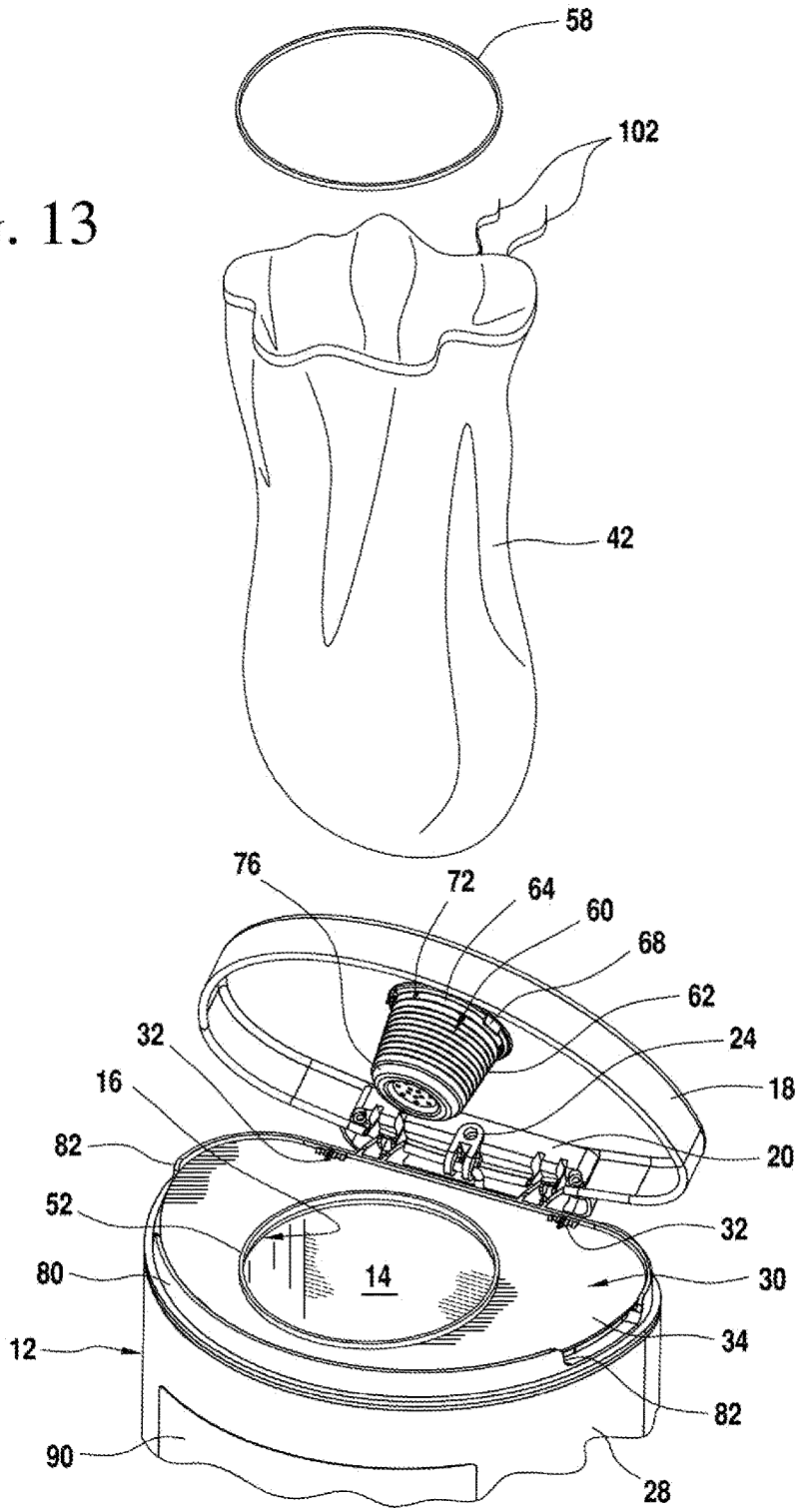
FIG. 13 is a perspective view of the container shown in FIG. 12 with the bag and hoop removed therefrom.
Figure 14:
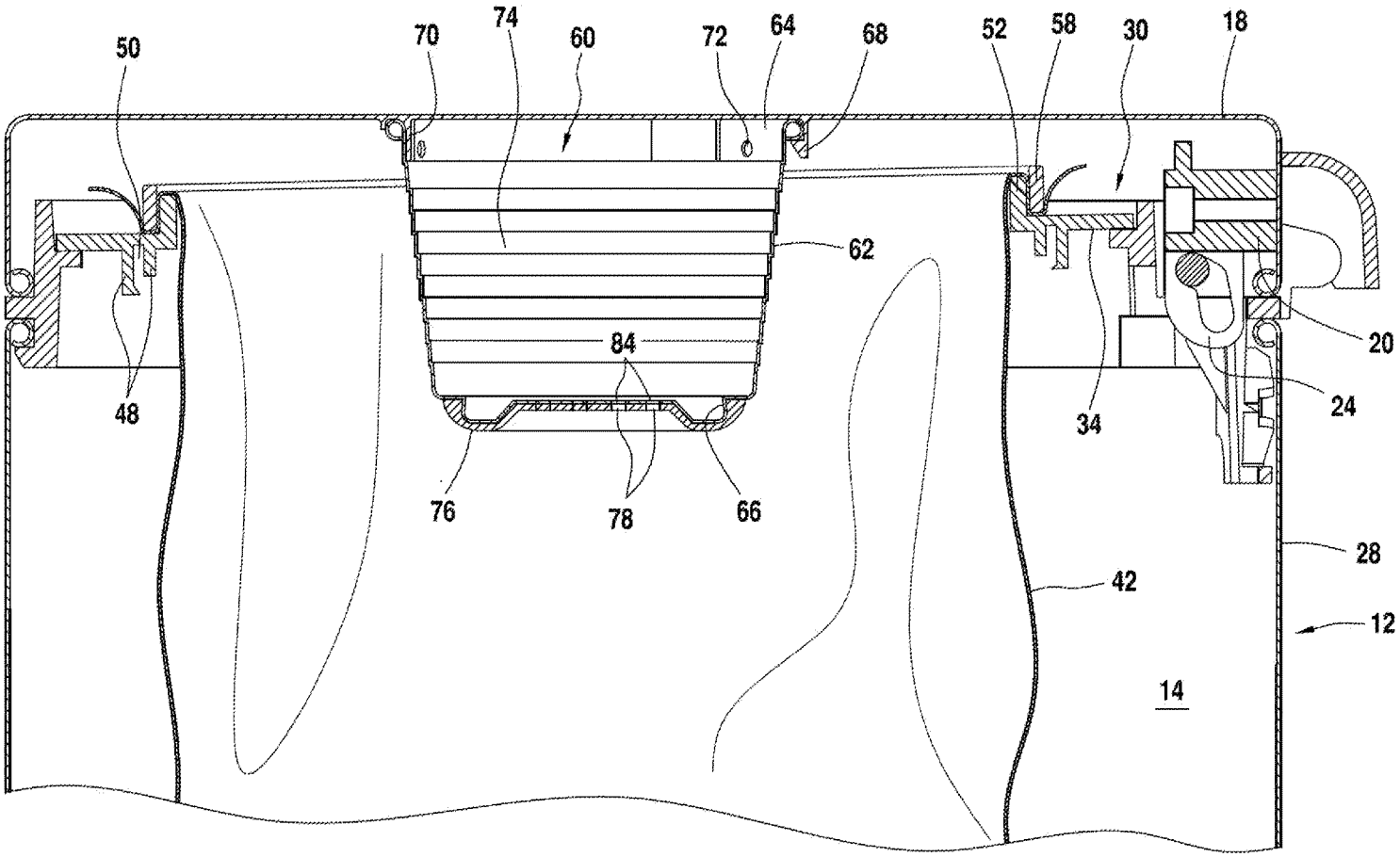
FIG. 14 is a cross-sectional view of a portion of the container shown in FIG. 12.

FIGS. 12-14 show another embodiment of container 10 wherein the closure component 30 does not retain a membrane, i.e., it is used without a membrane, and the container includes an optional side door 90 as shown in FIGS. 9-11. By virtue of the possible use of the container 10 without a membrane, the membrane is considered an optional feature. It may be attached to the closure component 30 when the user seeks to use the container for waste that is more easily insertable into the container with a membrane, yet then removed from the closure component 30 when the user seeks to use the container for waste that is more easily insertable into the container without a membrane.

In this embodiment, the base 62 of the waste treatment component 60 may be positioned such that the projections 68 on the underside of the lid 18 occlude the apertures 72 since there would be two sets of passages for deodorant or disinfectant to pass from the interior cavity 74 of the waste treatment component 60 to the bag 42, i.e., either through apertures 72 or through aligning apertures 78, 84.

The bag 42 of waste is removed from the compartment 14 either in the same manner as described above, i.e., through the top of the compartment 14 when the closure component is pivoted relative to the base 28, or simply by opening the door 90 to access the compartment 14.

Figure 15:
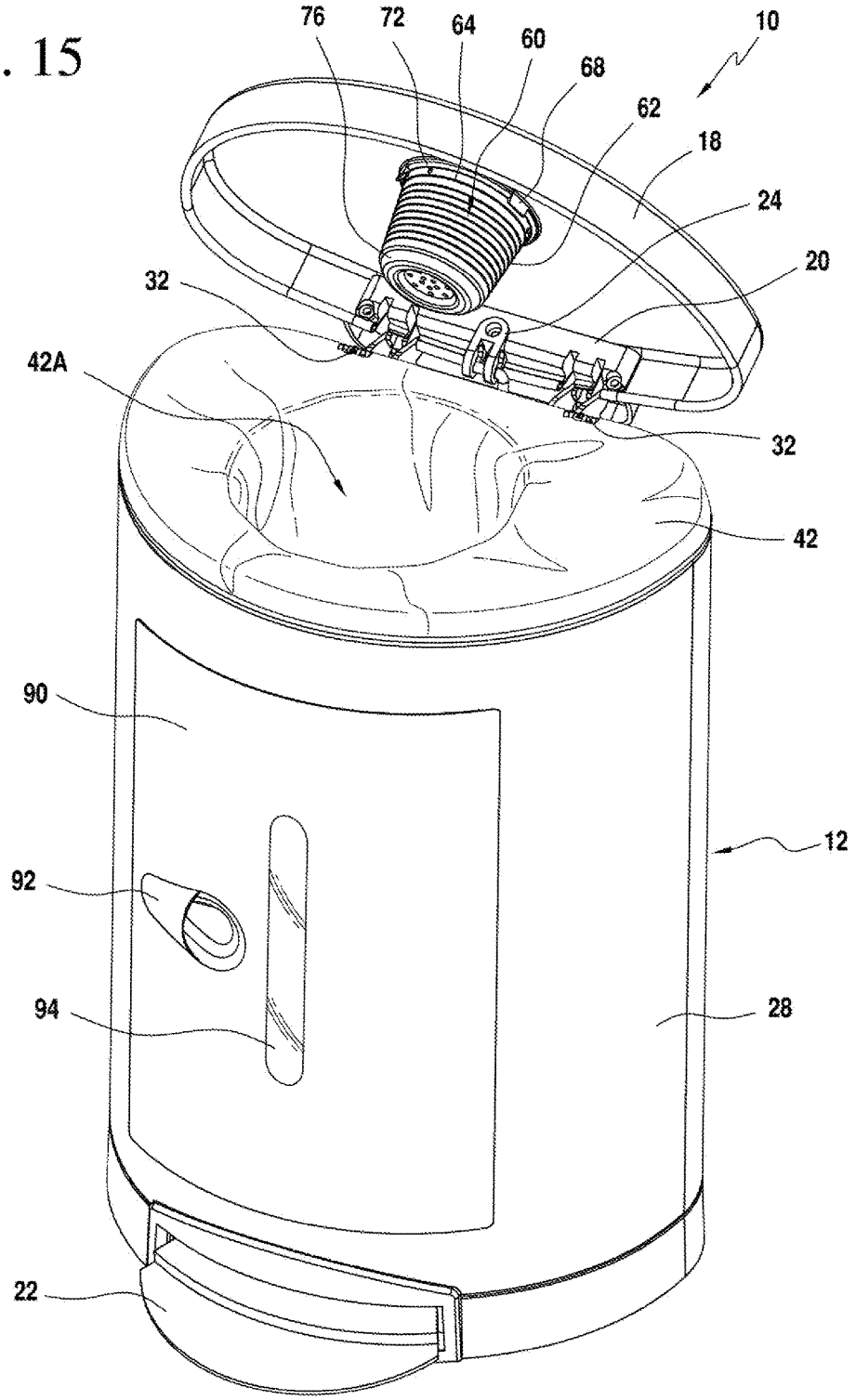
FIG. 15 is a perspective view of another embodiment of a waste container in accordance with the invention.
Figure 16:
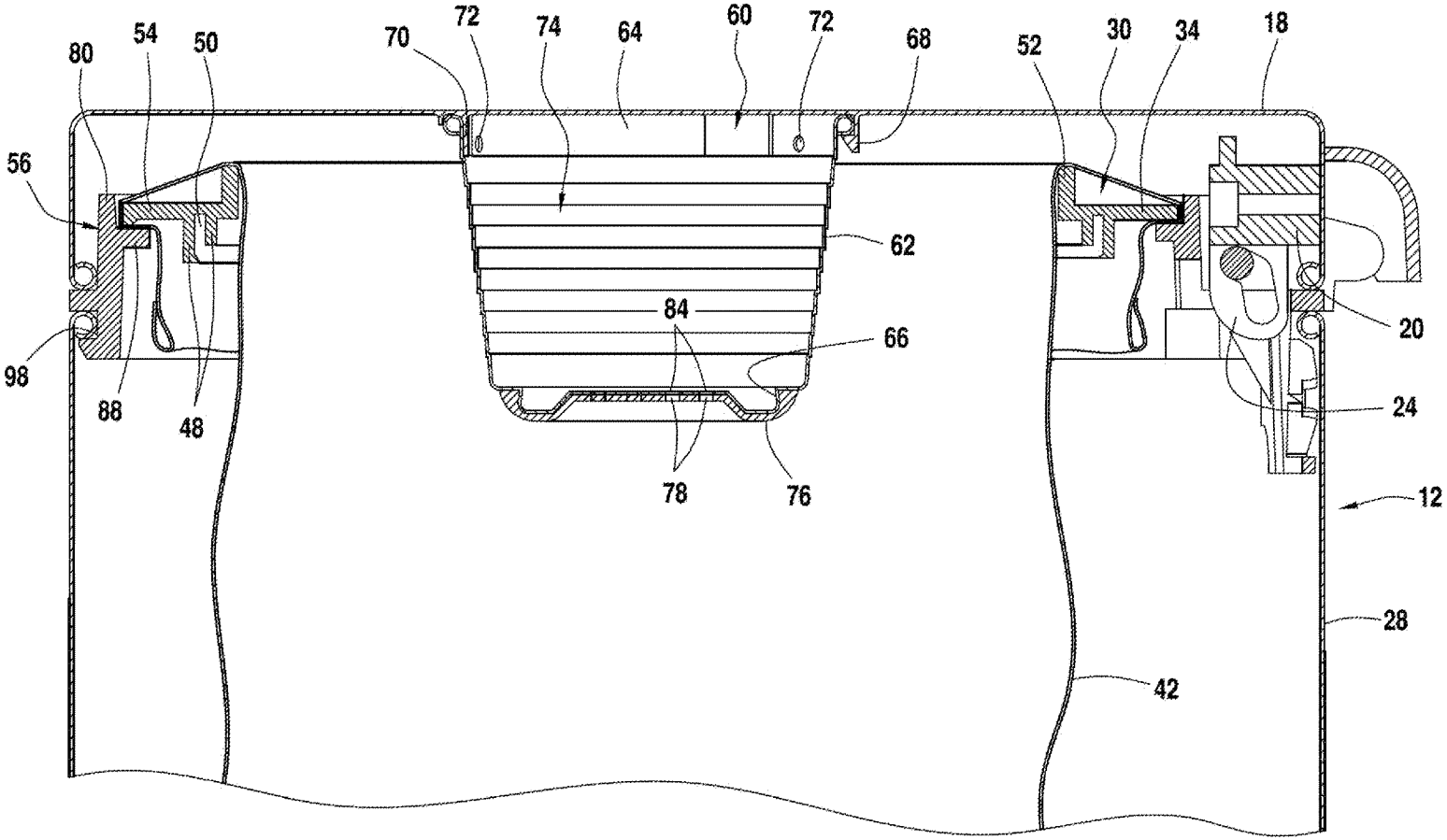
FIG. 16 is a cross-sectional view of a portion of the container shown in FIG. 14 with the lid in a closed state.
Figure 17:
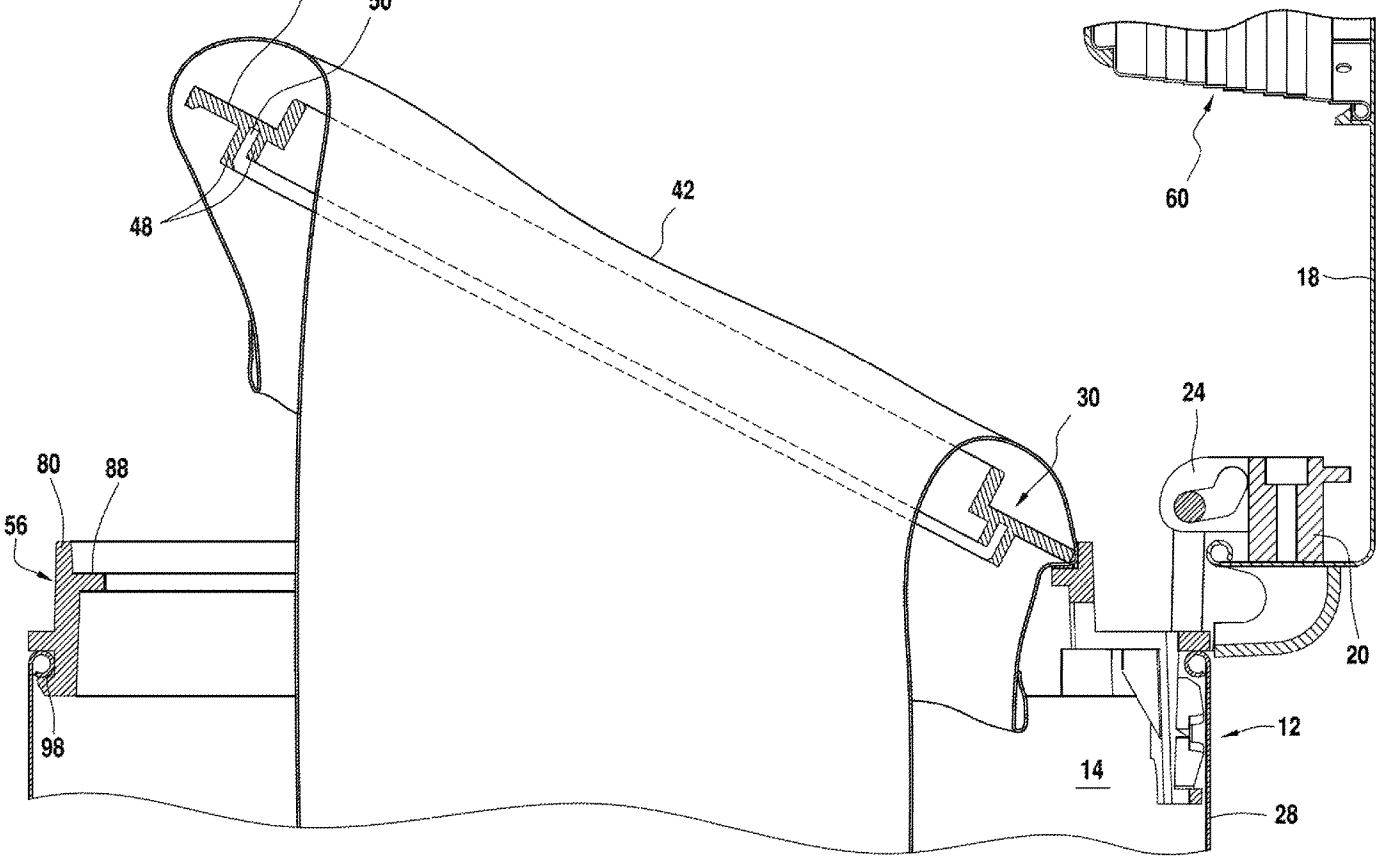
FIG. 17 is a cross-sectional view of a portion of the container shown in FIG. 14 with the lid in an open state.

FIGS. 15-17 show another embodiment of container 10 wherein the closure component 30 does not retain a membrane and is used without a hoop. The bag 42 may be placed through the opening 16 which is defined by the closure component 30 and then the flange of the bag 42 folded back on itself and around the support portion 34 of the closure component 30 (aside from the locations at which the hinges 32 are present (see FIG. 15 wherein the hinges 32 are visible when the bag 42 is in its use state). The bag 42 is thus secured between the inwardly projecting lip 58 of the closure component support portion 56 and the support portion 34 of the closure component 30 (see FIGS. 16 and 17).

In use, the container appears as shown in FIG. 15. The bag 42 is pressed downward into the compartment 14 until it is tightly drawn over the closure component 30.

Removal of the bag 42 when full is achieved, when the lid 18 is open, by lifting the front side of the closure component 30 upward relative to the hinged rear side to remove the flange of one part of the bag 42 from its securing between the closure component 30 and the closure component support portion 56 (see FIG. 17). The released flange of the bag 42 may then be inserted through the opening 16 and the closure component 30 removed to enable the flange of the bag 42 to be closed and lifted out of the compartment 14.

Figure 18:
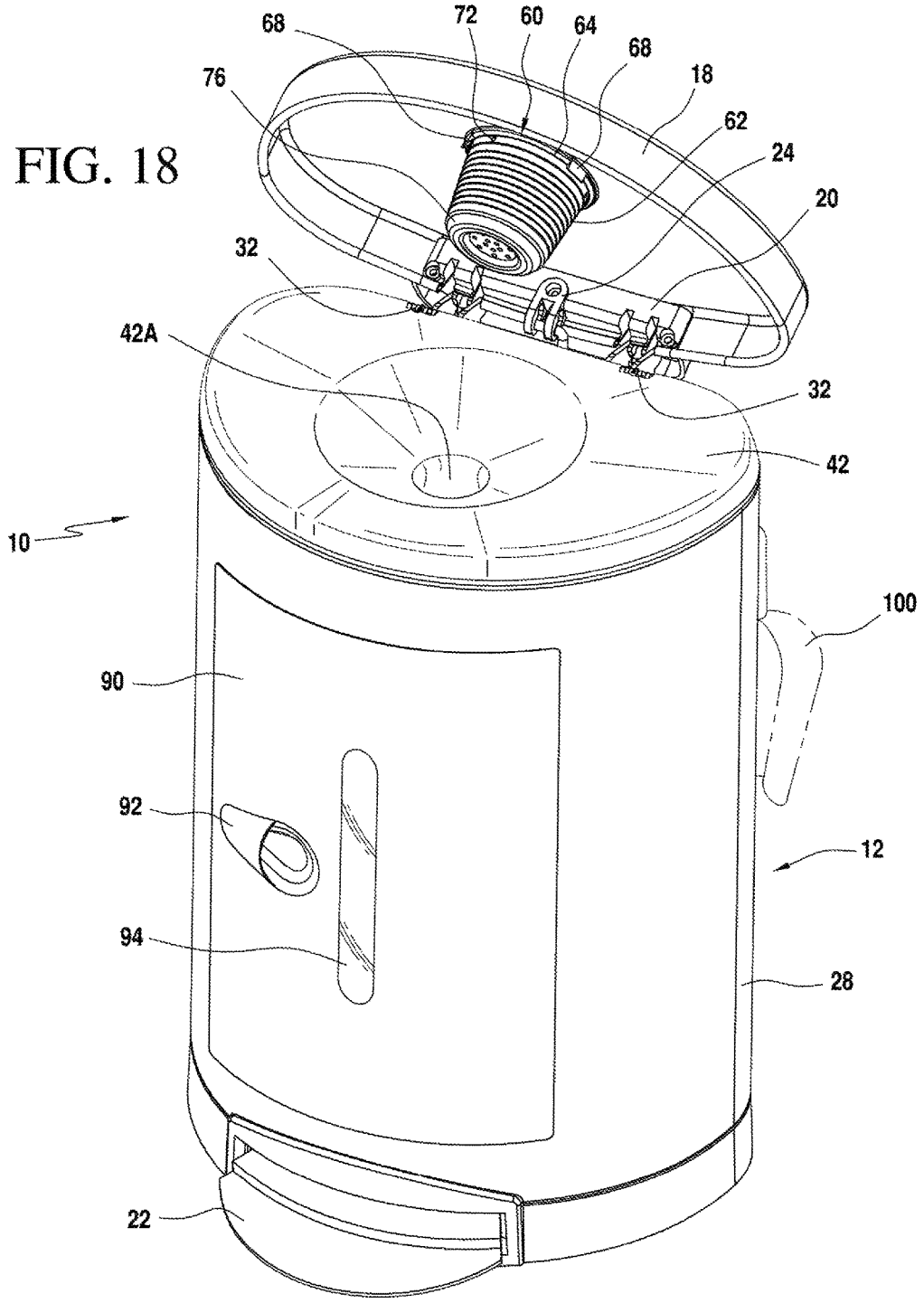
FIG. 18 is a perspective view of another embodiment of a waste container in accordance with the invention.
Figure 19:
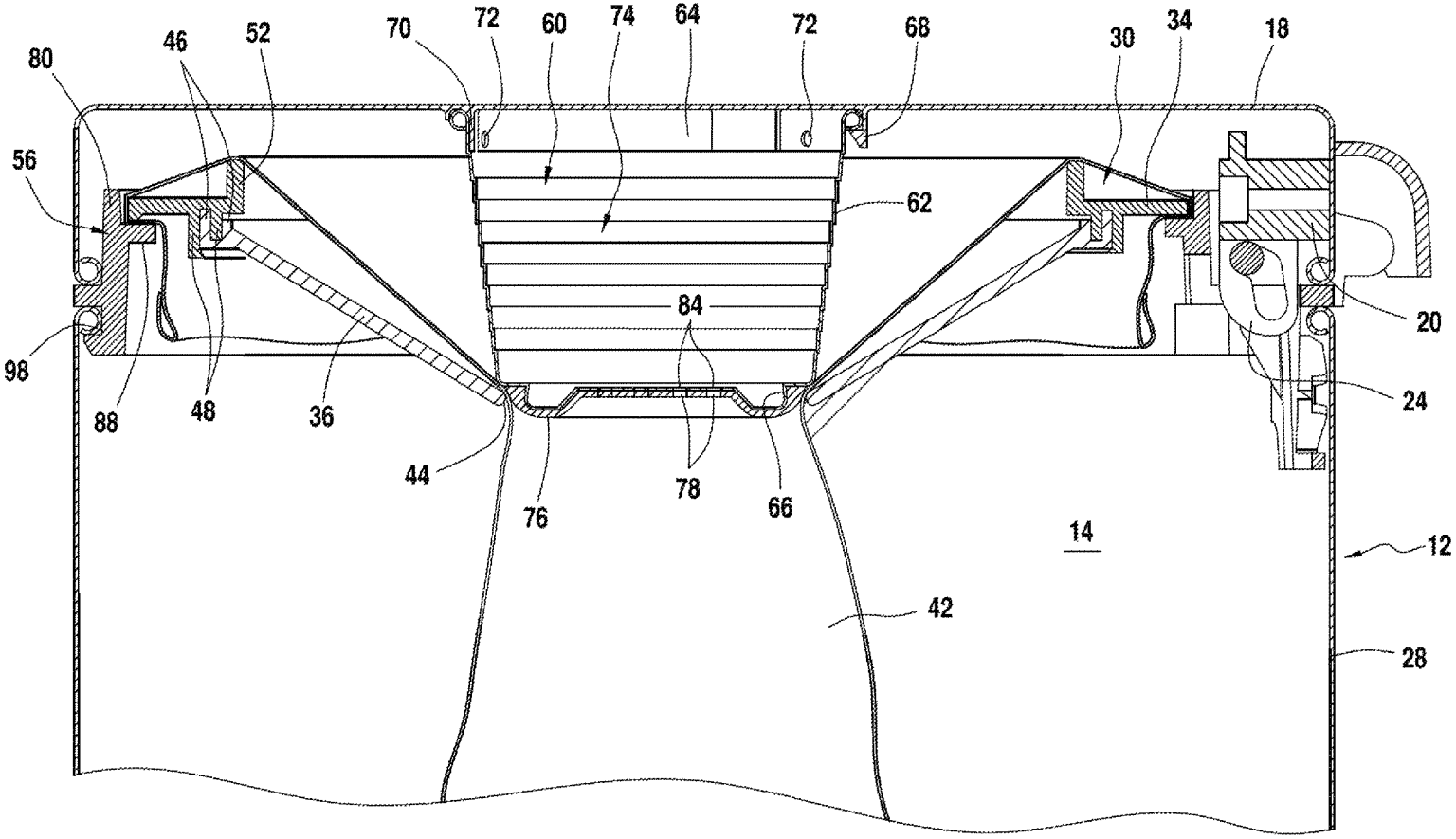
FIG. 19 is a cross-sectional view of a portion of the container shown in FIG. 18 with the lid in a closed state.

FIGS. 18 and 19 show another embodiment of container 10 wherein the closure component 30 retains a membrane 36 but is used without a hoop. As in the embodiment shown in FIGS. 15-17, the closure component 30 is pivotally attached to the base 12 of the container 10 via hinges 32 (see FIG. 18). For use, the bag 42 may be placed through the central opening 44 of the membrane 36 and then the flange of the bag 42 folded back on itself and around the support portion 34 of the closure component 30. The bag 42 and the closure component 30 are then placed on the closure component support portion 56 such that the bag 42 is secured between the inwardly projecting lip 58 of the closure component support portion 56 and the support portion 34 of the closure component 30 (see FIG. 19).

In use, the container appears as shown in FIG. 18 and is used in a similar manner as the container shown in FIGS. 15-17.

Figures 24, 25:
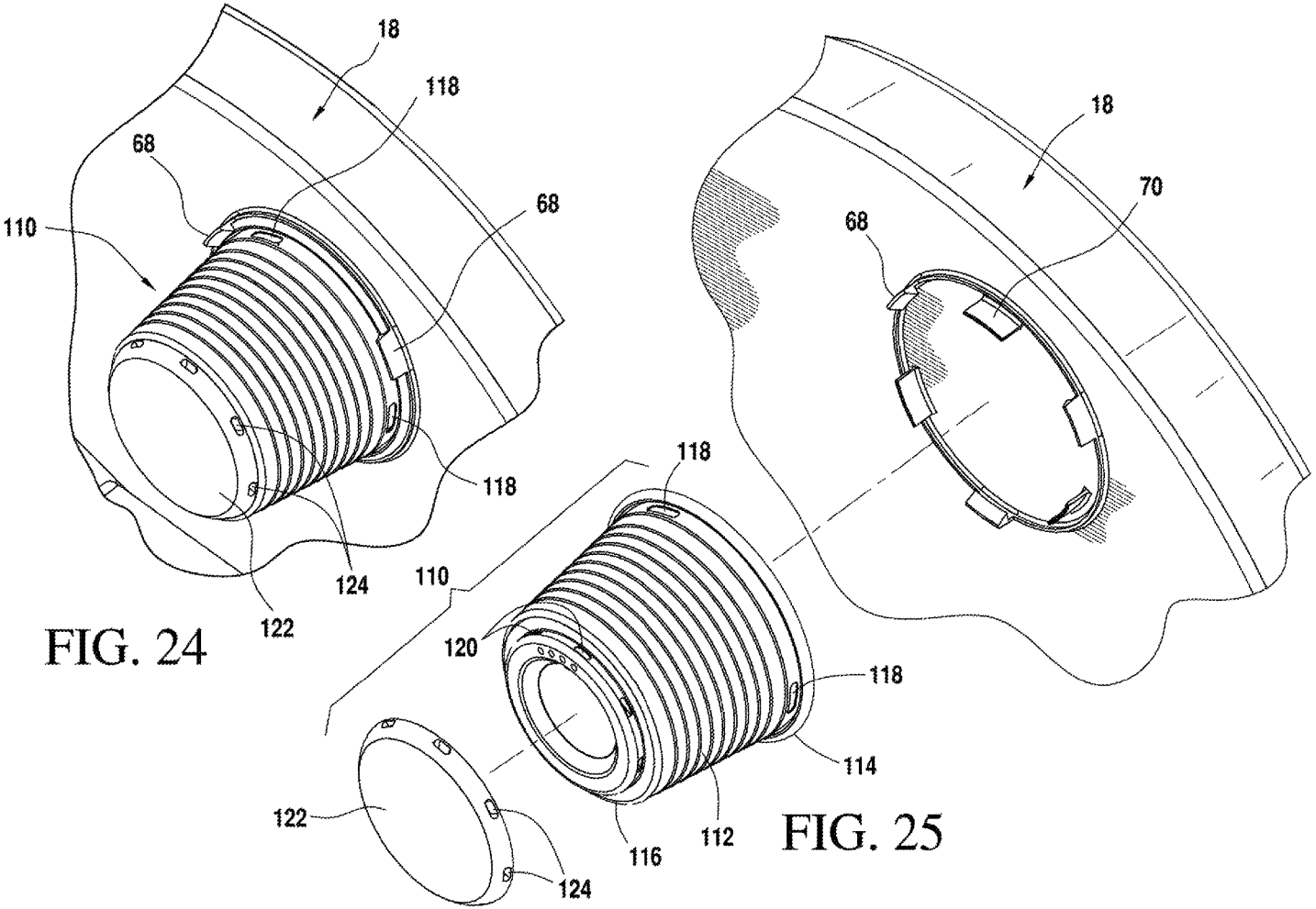
FIG. 24 is a perspective view of a second embodiment of a waste treatment component in accordance with the invention.
FIG. 25 is an exploded perspective view of the waste treatment component shown in FIG. 24.

Referring now to FIGS. 24 and 25, another embodiment of a waste treatment component that may be used in any of the embodiments disclosed herein is designated generally as 110 and includes a base 112 having an attachment portion 114 at an upper end and a conduit portion 116 at a lower end. Attachment portion 114 may comprise an enlarged rim that is designed to be positioned between projections 68, 70 on the underside of the lid 18 (see FIG. 25). Waste treatment component 110 may have features that are the same as or similar to those in waste treatment component 60, and vice versa, to the extent possible.

Also, attachment portion 114 includes apertures 118 that are preferably equal in number to the projections 68 and have the same circumferential spacing as the projections 68. In this manner, the waste treatment component 110 may be rotated to a position in which the projections 68 cover the apertures 118, and thereby prevent release of deodorant or disinfectant from an interior cavity of the waste treatment component 110 to the space between the bag 42 and the lid 18, or allow for release of deodorant or disinfectant from the interior cavity of the waste treatment component 110 to the space between the bag 42 and the lid 18 (this latter position being shown in FIG. 24). Rotation of the waste treatment component 110 can be effected manually depending on whether the user of the container 10 determines that there is a need to address unpleasant smells and odors between the bag 42 and the lid 18 or disinfect this area (or to neutralize bacteria, fungus, etc. or whatever treatment is being effected by the material in the waste treatment component 110). Rotation of waste treatment component 110 therefore controls the degree to which deodorant, disinfectant, air freshener, air purifier, antibacterial material, etc. is dispensed, released, distributed or disseminated into the space between the lid 18 and bag 42.

In contrast to the waste treatment component 60, in waste treatment component 110, the apertures 118 have a generally oval shape instead of a circular shape of apertures 72 (compare FIGS. 23 and 25). An oval shape for the apertures 118 generally allows for more deodorant, disinfectant or other waste treatment material in gaseous or powdered form, to pass therethrough.

Conduit portion 116 is formed as the bottom of the base 112 and includes a plurality of apertures 120 on a side face or surface through which deodorant or disinfectant from the interior cavity of the waste treatment component 110 is released to the interior of the bag 42 (see FIGS. 24 and 25). This is in contrast to waste treatment component 60 wherein the conduit portion 66 includes apertures 84 on a bottom surface (see FIG. 23). In further contrast, apertures 120 are oval shape as opposed to circular apertures 84 (see FIG. 25). Otherwise, waste treatment component 110 also includes a lower solid (lacking apertures) wall and a peripheral wall extending to one side of and from the lower wall. The interior cavity of the waste treatment component 110 is formed on one side of the lower wall and another cavity or compartment is formed on the opposite side of the lower wall (which is also receivable of waste treatment material (see FIG. 32).

Release of deodorant or disinfectant is controlled by the user by a rotatable member 122 attached to the base 112 to selectively cover or expose the apertures 120 (see FIGS. 24 and 25). Rotatable member 122 includes oval-shaped apertures 124 that selectively align with apertures 120 on the conduit portion 116 and/or solid portions of the conduit portion 116. There may be an equal number of apertures 124 as apertures 120 and they may have the same spacing to provide a relative positioning between the member 122 and the base 112 in which all of apertures 120 align with a respective aperture 124 (maximum outflow of waste treatment material) and a relative positioning between the member 122 and the base 112 in which all of apertures 120 are occluded by a solid portion of the member 122 (minimum or no outflow of waste treatment material).

One or more click stops may also be integrated into the waste treatment component 110 to guide the alignment of the apertures 124 relative to apertures 120. One embodiment includes four click stop detents that go from full opening (superimpose one over the other) to full closing.

Rotation of member 122 therefore controls the degree to which deodorant, disinfectant or other waste treatment material is released into the bag 42 from waste treatment component 110.

Member 122 may be provided with a bull nose or rounded face, or rounded portion that is opposite to the lower wall of the base 112, to facilitate pushing of waste through the bag aperture 42A. To this end, the waste treatment component mounting mechanism, i.e., projections 68, 70, are preferably positioned to align the member 122 with the central opening 44 of the membrane 36. Thus, during use of the container 10, any waste that is lodged in the bag 42 around the central opening 44 of the membrane 36 should be pushed by waste treatment component 110 into the portion of the bag 42 in the compartment 14 when the lid 18 is closed.

The presence of the bull nose on member 122 also improves the ability to clean the member 122 since it will likely come into contact with waste and be dirtied thereby during use of the container 10.

Instead of a removal mounting mechanism for the waste treatment component 110, a waste treatment component may be permanently attached to the underside of the lid 18.

Different constructions of a waste treatment component 110 are envisioned, in a similar manner as described above for waste treatment component 60.

Figure 30:
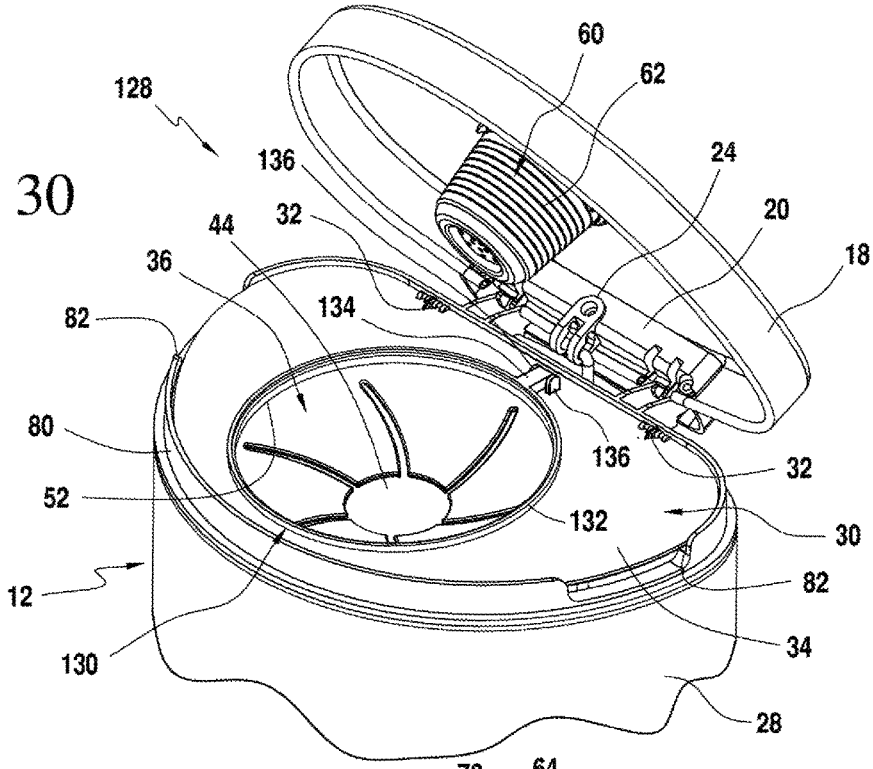
FIG. 30 is a partial view of a waste container in accordance with the invention showing a hoop is pivotally attached to the membrane support portion.

Referring now to FIG. 30, in this embodiment of a waste container, designated generally as 128, a hoop 130 is pivotally attached to the support portion 34 of the closure component 30 by a pivotal support mechanism, also referred to as pivotal mounting means. More specifically, the hoop 130 includes a substantially circular portion 132 and a flange 134 projecting outward from the circular portion 132, i.e., in a direction toward the rear side of the container as shown in FIG. 30. Two mounting projections 136 are arranged on the upper surface of the support portion 34. One or more pins (not shown) are then used to connect the flange 134 to the projections 136 to facilitate pivotal movement of the hoop 132 about a pivot axis defined by the pin(s).

This pivotal mounting of the hoop to the support portion 34, or more generally to the closure component 30, may be applied in any of the embodiments of a waste container disclosed herein.

It is possible to remove the hoop 132 from the projections 136 and store the hoop 132 on the underside of the lid 18, as described above. Thus, the waste container 128 may be used with or without the hoop 132. For example, different uses may be optimal for different sizes of the bag 42. For use with a relatively smaller bag, the hoop 132 would be installed and the bag secured between the hoop 132 and the projecting wall 58. For a relatively larger bag, the hoop 132 would be removed and the bag secured between the closure component 30 and the body 28, as described above.

Figure 31:
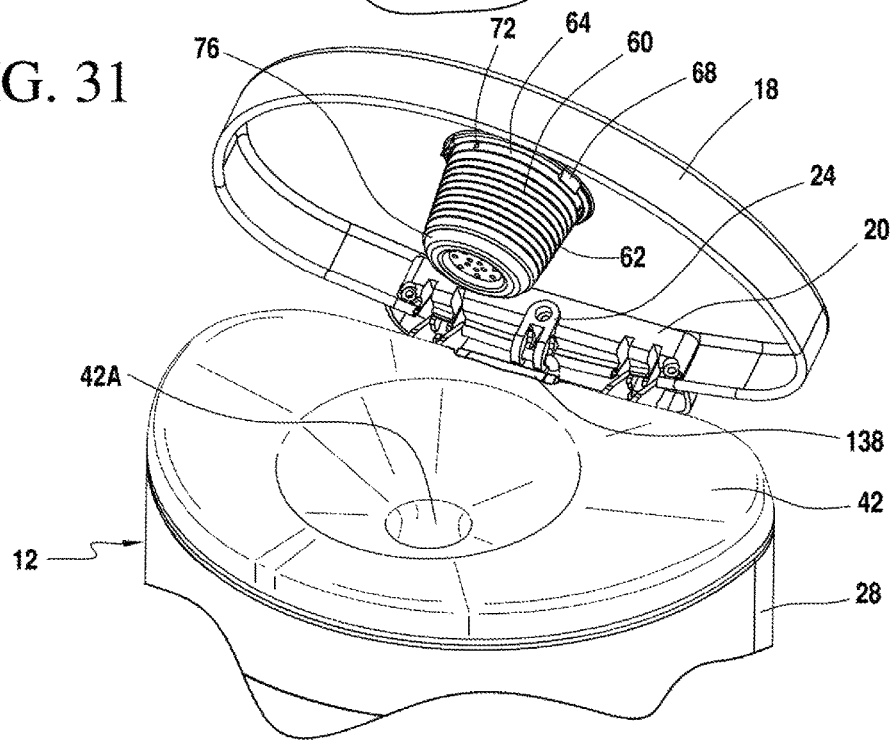
FIG. 31 is a partial view of a waste container in accordance with the invention showing a single hinge attached the membrane support portion to the base of the waste container.

Referring now to FIG. 31, another variation of the closure component 30 that may be applied to any of the embodiments of the waste container disclosed herein is to provide a single hinge 138 at the rear of the waste container. This single hinge 138 replaces the pair of spaced apart hinges 32 in some of the embodiments disclosed above. By providing a single hinge 138, instead of a pair of hinges 32, an advantage obtained when the bag 42 is installed is that the bag 42 may be more securely attached to the waste container 10 generally and more specifically to the closure component 30. Moreover, in this embodiment, the only pivotal connection between the body 28 and the closure component 30 is the single hinge 138, one part of which is connected to the body 28 and another, complementary part of which is connected to the closure component 30.

In the illustrated embodiments, the cross-sectional shape of the container taken in a horizontal plane when the container rests on a horizontal surface has a generally D-shape, i.e., may be referred to as a D-shaped container. The foot pedal 22 is situated at a central region of the curved edge of the D-shape and the lid mounting means are situated along the straight edge of the D-shape. The lid 18 therefore pivots about a horizontal axis extending in a direction substantially parallel to the straight edge of the container 10.

The waste containers in accordance with the invention optionally include a membrane which may be any of those shown in FIGS. 26-28. Each membrane 36, 36A, 36B may be used in any of the embodiments described herein, when a membrane is used (since some embodiments of the waste container described herein do not include a membrane). Alternatively, other membranes, such as disclosed in U.S. Pat. No. 8,215,089 (Stravitz) and U.S. Pat. No. 8,266,871 (Stravitz), both of which are incorporated by reference herein, may be used in the invention.

An advantage of the embodiments of the waste container described herein is that an inner liner for the base 12 is not required. Rather, the bag 42 serves as the liner for the base 12 and prevents waste from coming into contact with the inner surfaces of the body 28 of the base 12.

The type of bag 42 used in the containers disclosed herein may be any type of bag known to those in the waste disposal art. Any type of commercial garbage bag may be used. Deodorizing garbage bags may be used, e.g., a bag made of 7 layer EVOH and serves as an oxygen barrier. For some uses of the container 10, e.g., for cat litter and medical waste, it is preferable that the bag 42 not touch the bottom of the compartment 14 to allow for a cleaner funnel for gravity related substrates. This will insure a better tapered opening to receive the waste, especially as the bag 42 takes on weight from accumulating waste.

On the other hand, for waste that is urged into the bag aperture 42A, such as for example diapers, the bag can be longer to rest on the bottom of the compartment 14 or just touch the bottom, or be shorter than the bottom. The funneling (directing) and hands-free operations that are more necessary in cat litter and medical waste applications, are less prevalent for diaper disposal which requires urging or forced insertion of the waste through the bag aperture 42A and the central opening 44 of the membrane 36 into the portion of the bag 42 in the compartment 14.

If the bag 42 has a drawstring, the drawstring may be accessed and pulled to close the bag 42, either before or after the bag 42 is removed from engagement with the closure component 30 or membrane 36. In the former case, the pulled drawstring may be tied and then pushed into the compartment 14 so that when the closure component 30 is lifted up, the bag 42 is already closed. Alternatively, when a door 90 is provided, the door 90 may be opened to access and remove the closed bag 42.

The containers described above are not limited to use for any particular type of waste. The containers may be used for cat litter, diapers for children or adults, kitchen products, bathroom waste, medical waste, general waste and the like.

For medical use, it is possible to use the container in a hands-free mode whereby the user with medical waste uses their foot to open the lid 18 by depressing the foot pedal 22 and then drops the medical waste into the bag aperture 42A or along the portion of the bag 42 that overlies the funnel-shaped membrane 36. By the effect of gravity, the waste falls through the bag aperture 42A into the portion of the bag 42 in the compartment 14. For bio-hazardous waste, a red-colored bag 42 may be used. The lid 18 remains open as long as the user keeps their foot on the foot pedal 22. When pressure on the foot pedal 22 is released, the lid 18 closes and the waste treatment component 60, 110 forms a comfortable, temporary seal keeping bacteria and fungus and smell from migrating upward from the waste in the bag 42 in the compartment 14.

This should prevent potentially harmful airborne fungus and bacteria from finding their way up to the inside top and edges of the lid 18, and thus prevent the release of these organisms to enter the room in which the container is situated and find their way up through vents in hospitals and nursing homes and doctor's offices, etc.

Thus, the waste treatment components 60, 110 when used in the container 10 in accordance with the invention provide three important functions, control of odor below the lid 18 (i.e., in the space between the lid 18 and the portion of the bag 42 that overlies the membrane 36), control of odor below the membrane 36 (inside the portion of the bag 42 in the compartment 14 in which waste is retained), and seal in offensive and potentially harmful odor when the lid 18 is closed. This combination of three features renders the container 10 including the waste treatment component 60, 110 extremely useful for all types of waste as described above.

An important feature of the invention that arises from the fact that the membrane 36 does not rotate relative to the base, as is common in some prior art waste disposal devices (e.g., in the U.S. patents mentioned above). Since the membrane 36 does not rotate, there is no restriction or limitation on the size and shape of the membrane 36, which are often present when a membrane has to rotate for operation of a waste disposal device.

Figure 32:
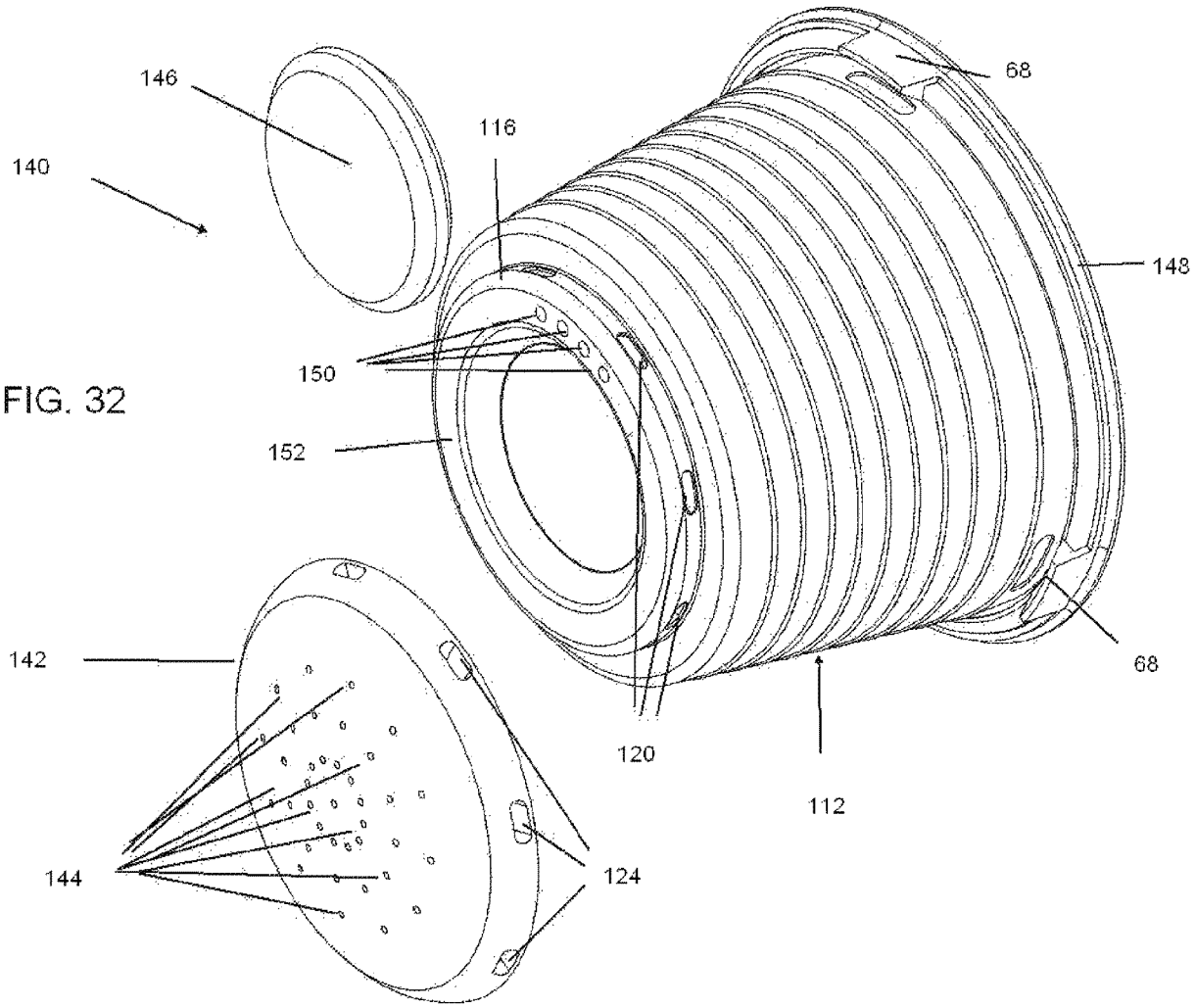
FIG. 32 is a perspective view of another embodiment of a waste treatment component in accordance with the invention.

Referring to FIG. 32, another embodiment of a waste treatment component 140 in accordance with the invention is shown. Waste treatment component 140 includes components similar to waste treatment component 110, namely the base 112 and a rotatable member 142 that is similar to rotatable member 122 except that it includes apertures 144 in a portion opposite to the lower wall of the base 112. Rotatable member 142 is attached to the base 112 to at least partly cover the lower end of the base 112, e.g., partly or completely cover the lower wall of the base 112.

A gel bar 146 or other form of deodorant or disinfectant may be optionally positioned in the space between the conduit portion 116 of the base 112 and the rotatable member 142, and thus the apertures 144 facilitate enable release of the deodorant or disinfectant for gel bar 146. This space defines a second or additional compartment receivable of waste treatment material, whose dispersal is effected via the pattern of apertures 144 in the portion of the member 142 that is opposite (faces) the solid lower wall of the base 112. The solid lower wall of the base 112 therefore separates two waste treatment material-receivable compartments, i.e., has one compartment formed on one side and another compartment formed on the other, opposite side.

Waste treatment component 140 can be a stand-alone unit, and to this end, includes a cover 148 that covers the open upper end of the base 112. Thus, there is a lower, solid wall, a peripheral wall extending to one side of and from the lower wall (both defined by the base 112) and an upper wall defined by the cover 148 that removably engages with the base 112. Cover 148 includes the projections 68, 70 shown in FIG. 23 (the purpose, function and location of which are described above). Cover 148 is provided with an attachment device (not shown) to attach the cover 148, and thus the waste treatment component 140 when the base 112 is attached to the cover 148, to for example, the underside of a lid of a waste container. Since this embodiment is not required to be used for a waste container, the waste treatment component 140 can also be considered a deodorant or disinfectant and attached to other surfaces, whether a vertical surface in a closet or on a wall or a horizontal surface such as a ceiling or floor. The attachment device may be adhesive tape, hook and loop fasteners and the like.

Another advantage of this embodiment is that it is possible to place different compounds in the base 112 and between the base 112 and the rotatable member 142. Distribution of each compound is independent, i.e., distribution of the material of the gel bar 146 is through the apertures 144, and distribution of the compounds in the base 112 is through the aligning apertures 120, 124 and selectively closed apertures 118. Alternatively, a compound may be placed only in the upper compartment defined by the base 112, as described above, without use of the gel bar 146 Alternatively, it is possible to cause mixture of two compounds, with the compound in the upper compartment defined by the base 112 passing into the compartment defined between the base 112 and the rotatable member 142 through apertures (e.g., like apertures 84 defined in the bottom of the base 112 as shown in FIG. 23), mixing therewith and then being dispensed through apertures 144. Click stops 150 are formed in the rim 152 to control rotation of the member 142.

Referring now to FIGS. 33-36, other embodiments of the invention use a component similar to the hoop 58 to secure an upper portion of a bag to prevent rotation of the top of the bag. These embodiments may be used in a variety of different waste containers and the arrangement of the bag securing assemblies or components is not limited to any specific waste container. For example, the waste container may be a basic waste container with a lid that closes or opens the opening into the bag. The bag may or may not rotate. The bag is preferably secured against falling into the waste-receiving space of the waste container.

The waste container may be one that has a rotation mechanism operative against a portion of the bag above the bottom or a hanging portion of the bag. With this type of waste container, the bag is prevented from rotating at its upper region when a lower portion of the bag is being operatively rotated by the rotation mechanism, thereby enabling formation of a twist in the bag or the bag to be untwisted, depending on the direction of rotation and the configuration of the rotation mechanism. Advantages of the twist to prevent egress of odor and bacteria are known to those skilled in the art to which this invention pertains, and disclosed in patents mentioned above.

Another possible waste container that may utilize the bag securing assembly or component of the invention is one in which the bag securing assembly or component itself is rotated to cause the formation of a twist in the bag, or to untwist the bag, again depending on the direction of rotation and the configuration of the rotation mechanism. In this case, the waste is held against rotation while the upper region of the bag is rotated.

Thus, in general, the bag securing assembly and component embodiments described below may be used in various waste containers, or waste disposal devices.

In a first one of these embodiments, the waste container 200 receives an insert 202 to which a bag 204 is attached, and also includes a base 196 and a lid 198 operative and having structure as described in any of the embodiments herein. The insert 202 rests on a support 206 in the waste container 200. The insert 202 may have a form similar to the form of cartridges conventionally used in waste disposal devices. However, the insert 202 differs from cartridges in that it does not include pleated tubing. Rather, the insert 202 has a single bag 204 attached to it. This attachment may be by means of adhesive or other comparable attachment structure. Alternatively, the bag 204 may be wrapped around the insert 204, or part thereof, and then trapped so as to be prevented from being dragged into the waste container.

In one particular embodiment, a bag will be slipped through the opening defined by the insert, and/or through an optional membrane 194 (see FIG. 35), and while empty, wrapped around the insert 204 or part thereof sufficiently such that the bag is then trapped at or against at least one bag-engagement surface (such as at a top edge of the insert over which the bag 204 is draped). This trapping technique, or a comparable attachment mechanism, functions to attach the bag 204 around its periphery to an annular surface of the insert 202, possibly a radially outward facing surface of an inner wall of the insert 202.

Figure 36:
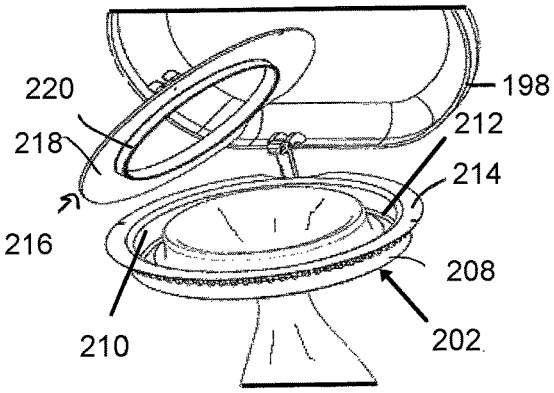
FIG. 36 is a view showing internal parts of the waste container shown in FIG. 33.

For example, as shown in FIG. 36, the insert 202 includes a vertically oriented outer peripheral, circular wall 208, a vertically oriented inner peripheral, circular wall 210, a horizontal annular bottom wall 212 extending between lower edge regions of the outer wall 208 and the inner wall 210, and a support flange or lip 214 extending radially outward from an upper edge region of the outer wall 208. The insert 202 is supported on the support 206 by the support lip 214 that rests on the support 206 of the waste container 200, whether in contact therewith or with an interposition.

Figure 33:
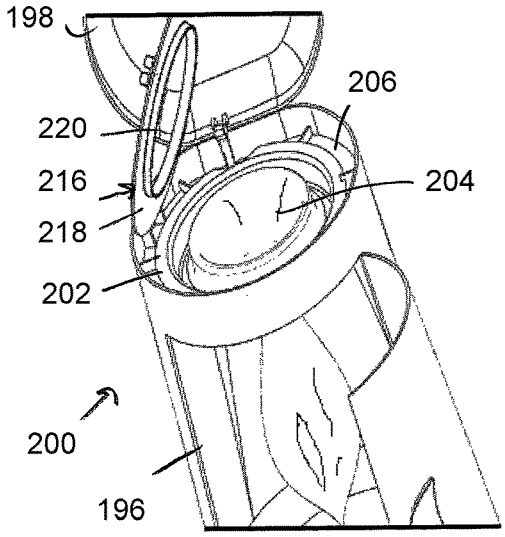
FIG. 33 shows another embodiment of a waste container in accordance with the invention with a closure component in a non-engagement position.
Figure 34:
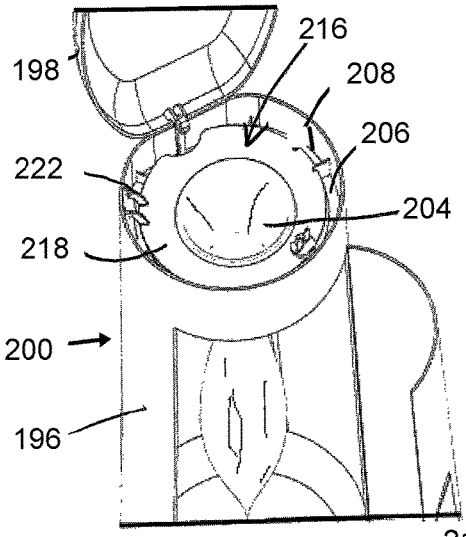
FIG. 34 shows the embodiment of a waste container in accordance with the invention as shown in FIG. 33 with the closure component in an engagement position.

The bag 204 may be trapped against or attached to the radially outward facing surface of the inner wall 210 so that the bag 204 passes over the upper edge of the inner wall 210 and then into the interior waste-receiving space of the container 200 (see FIG. 33). A bag-engagement surface is thus formed by the inner wall 210 at or around its top edge, and on the radially outward facing surface and on the radially inward facing surface.

To maintain the upper region of the bag 204 fixed against rotation and prevented from being dragged down into the waste container when waste is introduced, a closure component 216 may be pivotally attached to the waste container 200, e.g., to the support 206 of the waste container 200. Closure component 216 includes a horizontal annular disc portion 218 and a vertically oriented rim 220 extending downward from the inner edge of the disc portion 218 (see FIG. 36) to provide the closure component 216 with an "L"-shaped cross-section. The rim 220 serves to engage the bag 204 securely at at least one edge. It is possible that engagement here can be on up to three sides of the bag, i.e., the top, side and bottom edge, if the rim 220 has a channel accommodating the top edge of the insert 204.

Figure 35:
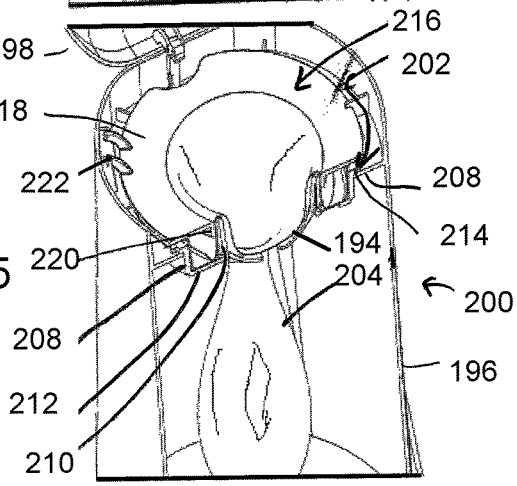
FIG. 35 is a partial cross-section of FIG. 34.

In the embodiment with only a single bag-engagement surface being provided, the location of the rim 220 is coordinated to the dimensions of the insert 202 to cause the rim 220 to fit slightly inward of the inner wall 210 with the result that the bag 204 is sandwiched with tight fit between the rim 220 and the inner wall 210 (see FIG. 35). This tight fit, e.g., with the rim exerting outward pressure toward the inner wall 210 and thus pressing the bag 204 against the outer surface of the inner wall 210, prevents movement of the upper region of the bag 204, e.g., in the event of rotation of a lower region of the bag or waste therein. While not shown, it is possible for the rim 220 to engage the inner wall 210 on the inner portion of the inner wall 210. Here engagement can be in up to two places, namely, with the rim 220 exerting inward pressure toward the inner wall 210 and thus pressing the bag 204 against the inner surface of the inner wall 210, and also with the horizontal portion 218 of the closure component 216 pressing against the top edge of the insert 210.

In the illustrated embodiment, by virtue of the "L"-shaped cross-section of the closure component and the design to provide the rim 220 inward of the inner wall 210 of the insert 202, causes engagement between the closure component 216 when in an engagement position and the insert 202 at only a single bag-engagement surface, i.e., the radially inward facing surface of the rim 220 presses the bag 204 against the radially outward facing surface of the inner wall 210. As mentioned above, it is also possible to provide an embodiment, although not shown, in which the radially outward facing surface of the rim 220 presses the bag 204 against the radially inward facing surface of the inner wall 210. In this case, the bag would be trapped equally as well, although you are closing the opening being provided by the bag 204 by a wall thickness of the rim 220. One advantage here might be that the upper area of the bag is being protected from possibly stretching or even tearing, since it is under the rim 220.

The structure 222 that pivotally attaches the disc portion 218 to the support 206 may be any known pivotal attachment structure.

FIGS. 37-39 show another embodiment wherein a waste container 224 includes a support 226 having recesses 228 and that is designed to receive an insert 230. Insert 230 includes an annular disc 232 and projections 234 projecting from an outer peripheral edge thereof, the projections 234 being received in the recesses 228. To this end, the projections 234 preferably have a shape, size and position to enable them to fit into the one or more recesses 228. By providing recesses 228 on the waste container 224 and projections 234 on the insert 230, rotation of the insert 230 relative to the waste container 224 is prevented. This rotation may arise if the waste container 224 is provided with a rotation mechanism to rotate the waste or bag in order to form a twist. However, if the waste container does not include a rotation mechanism, then the recesses 228 and projections 234 on the insert 230 are unnecessary, and a comfortable interference fit may be provided between the insert 230 and the waste container 224. Moreover, the projections 234 could be inward recesses if the waste container has inwardly oriented projections. Instead of multiple projections 234, a single projection 234 may be provided. Also, anti-rotation of the insert 230 may be provided by suitable shaping of the annular disc in an alternative shape to generally round, e.g., square-shaped.

Annular disc 232 also includes a vertically oriented inner peripheral, circular wall 236, a horizontal ledge 238 extending radially inward from the upper edge of the inner wall 236 and a small vertically oriented annular wall 240 extending from the inner edge of the ledge 238 (see FIG. 39). The ledge 238 and annular wall 240 may be omitted and an annular disc provided with only the inner wall 236.

Insert 230 also includes a closure component 242 that is pivotally connected to an upper surface of the annular disc 232 by an attachment structure 244 known to those skilled in the art to which this invention pertains. Closure component 242 serves to fix the bag 204 to the inner wall 236, ledge 238 and annular wall 240, providing three bag-engagement surfaces. To this end, the closure component 242 includes an annular portion 246 having a U-shape cross-section (see FIG. 38). The cross-section includes a vertically oriented outer wall 248, a vertically oriented inner wall 250 and a horizontal transverse wall 252 which together define a channel 254 oriented downward. When engaged with the annular disc 232, the outer wall 248 surrounds and presses the bag 204 against the inner wall 236 of the annular disc 232 (a first bag-engagement surface), the inner wall 250 is inward of and presses the bag 204 against the annular wall 240 of the annular disc 232 (a second bag-engagement surface) and the transverse wall 252 presses the bag 204 against the ledge 238 (a third bag-engagement surface, as shown in FIG. 39.

It is possible for the closure component 242 to have an "L"-shaped cross-section, and designed to overlie the inner wall 236 with slight clearance to thereby provide a two bag-engagement surface embodiment, i.e., along the top of the inner wall 236 and along its radially inward facing surface which would be pressed by the top of the closure component and the radially outward facing surface of the rim of the downwardly facing rim of the closure component.

With this construction of the annular disc 232 and the closure component 242, the bag 204 can be secured by the closure component 242 to the annular disc 232 with three bag-engagement surfaces. Alternatively, if the closure component is "L"-shaped, the bag 204 would be secured by the closure component 242 to the annular disc 232 with two bag-engagement surfaces.

Closure component 242 also includes a tab 256, e.g., opposite the pivotal attachment point, to facilitate easy lifting of the closure component 242. Instead of a tab 256, a small raised rib may be provided, which is pinched to lift it along with the closure component 242. Generally, the tab 256 represents means for enabling lifting of the closure component.

In use, a bag may be obtained and inserted into the opening defined by the insert 230 into the waste-receiving compartment of the waste container 224 while the closure component 242 is pivoted into an upper, non-engagement position. An upper edge region of the bag 204 is held, and placed around the inner wall 236, overlying the ledge 238. The closure component 242 is then pivoted onto the annular disc 232 to cause the bag 204 to enter into the channel 254 and be pressed by the outer wall 248, inner wall 250 and transverse wall 252 against opposite portions of the annular disc 232. The bag 204 is thus secured in placed with the closure component 242 in an engagement position with the annular disc 232.

When the bag 204 is full of waste and it is desired to remove the bag 204, the closure component 242 is pivoted upward by grasping the tab 256 and lifting it upward, the open end of the bag 204 may be sealed, tied or clasped close and urged or inserted through the opening into the waste container with the bag 204 being removed from the waste container 224 through a front or side door. The insert 230 could also be designed to pivot upward to expose the interior of the waste container and then allow for removal of the bag 204 full of waste.

This embodiment also includes an optional membrane 194 below the insert 230, which membrane may be as disclosed above.

FIG. 40 shows a variant of the insert, designated insert 230A wherein the insert is made of two parts. Insert 230A includes an annular disc 232 with optional projections 234, and a separate wall portion 270 that has the inner wall 236, ledge 238 and annular wall 240 (see also FIG. 47). Moreover, the wall portion 270 includes an attachment structure 272 to enable the wall portion 270 to be attached to an inner edge of the disc 232. The attachment structure 272 may be an indentation that snap-fits to the inner edge of the disc portion 270, or is attached thereto by an interference fit, or by threads.

FIG. 41 shows a variant of the insert 230A, designated 230B, wherein elongate detents or ridges 258 are formed on the outer surface of the inner wall 236 of the wall portion 270. These detents 258 aid in the engagement of the closure component 242 with the annular disc 232. Detents may be provided on any of the inserts or closure components disclosed herein.

FIG. 42 shows an embodiment wherein the closure component 242 is attached to the support 226 of the waste container 224 by an attachment structure 260, instead of being attached to the annular disc 232.

Figure 43:
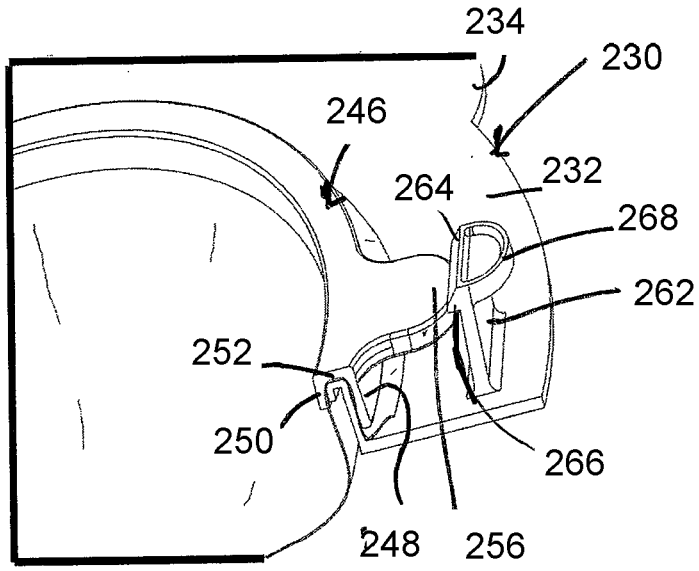
FIG. 43 is a partial cross-section showing a retainer for a tab.

FIG. 43 shows an embodiment wherein an optional retainer 262 is arranged on the annular disc 232 and engages with the tab 256 on the closure component 242 to prevent inadvertent disengagement of the closure component 242 from the annular disc 232. Retainer 262 may be provided in any embodiment disclosed herein wherein there is a tab 256. The retainer 262 is shown mounted on the upper surface of the annular disc 232. Alternatively, it may be integrated into the annular disc 232, or it may be arranged on or integrated with the support 226 of the waste container 224 or with another part of the waste container 224.

The primary change in use of this embodiment is only that when engaging the closure component 242 with the annular disc 232, the tab 256 is pressed downward against the angled surface 264 of the retainer 262 to cause the retainer 262 to flex rearward slightly and allow the tab 256 to be pressed into a position below the lip 266 when the tab 256 returns to its initial position. The tab 256 could be rounded to make it easier to snap in and out without having to move the retainer 262 out of the way first. A half round profile for the tab 256 would allow you to lift the tab 256 and therefore urge the retainer 262 to spring away. Release of the tab 256 when seeking to disengage the closure component 242 from the annular disc 232 entails flexing the flange 268 of the retainer 262 rearward to allow the tab 256 to be released from its position below the lip 266.

Figure 44:
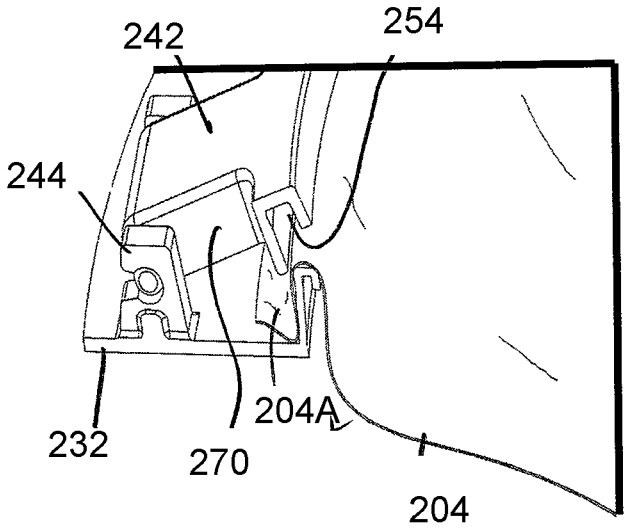
FIG. 44 is a partial cross-section showing a closure component that is capable of providing four bag-engagement surfaces.

FIG. 44 shows a variant wherein the closure component 242 provides four bag-engagement surfaces. In this embodiment, an extension portion 270 of the closure component 242, that extends between the annular portion 246 and the attachment structure 244, has a lower edge or surface that presses a portion 204A of the bag 204 that rests on the annular disc 232. This excess portion of the bag 204 is draped over the insert 230 and size-permitting, can be pressed against the annular disc 232 by the extension portion 270. In the same manner, if the closure component 242 were "L" shaped and provided two bag-engagement surfaces, then when the extension portion 270 presses the bag 204 against the annular disc 232, there would be three bag-engagement surfaces of the closure component 242.

FIGS. 45-48 show an embodiment wherein a closure component 242A is not pivotally attached to the waste container 224 or to the insert 232. Rather, the closure component 242A is free standing. Otherwise, closure component 242A has the same or similar structure and features as closure component 242.

This embodiment also shows an alternative insert, designated 230C. Insert 230C includes an annular disc 232 with optional projections 234, and a separate wall portion 270 that has the inner wall 236, ledge 238 and annular wall 240. Moreover, the wall portion 270 includes an attachment structure 272 to enable the wall portion 270 to be attached to an inner edge of the disc 232. The attachment structure 272 may be an indentation that snap-fits to the inner edge of the disc portion 270, or is attached thereto by an interference fit, or by threads.

FIGS. 49-51 show another embodiment of a bag securing assembly 280 including an insert 282 that rests on a support in a waste container and a closure component 284 attached to the insert 282. The insert 282 is circular and has a bottom wall 286, an outer annular wall 288 extending upward from a radially outer edge of the annular wall 286 and an inner annular wall 290 extending upward from a radially inner edge of the annular wall 286. Inner wall 290 has a larger height than the outer wall 288.

An attachment structure 292 is arranged on the upper surface of the bottom wall 286 and pivotally supports the closure component 284 (see FIGS. 49 and 50). The closure component 284 may have the same structure and features as closure components disclosed elsewhere herein, and when in an engaged position, fits the bag 204 into its channel to thereby secure the bag 204 against rotation.

Bag securing assembly 280 is used in the same manner as the other bag securing assemblies disclosed herein. To wit, the insert 282 is placed onto a support of a waste container, a bag 204 is inserted through the opening defined by the insert 282 into the waste-receiving compartment defined by the waste container with an upper edge region remaining above the insert 282, and with the closure component 284 in a non-engagement position. This upper edge region is then extended over the inner wall 290 and pulled downward toward the bottom wall 286. The closure component 284 is then pivoted downward, e.g., by pressing the tab 256, to cause the bag 204 to be pressed into the channel 254 and against the inner wall 290 by the closure component 284.

Removal of the bag 204 is facilitated by lifting the closure component 284 out of engagement with the insert 282 thereby releasing the upper edge region of the bag 204, and allowing it to be tied and the bag removed from the waste container in a manner described above.

As shown in FIG. 51, the attachment structure 292 is not required and may be eliminated. In this embodiment, the closure component 284 is not connected to the insert 282 when in its disengagement position.

Referring finally to FIGS. 52-55, in this embodiment, the bag securing assembly also allows the bag to be rotated. The bag securing assembly 300 includes an insert 302 with an annular disc 304 having projections 306, and a closure component 308 that is not attached to the insert 302. The annular disc 304 also includes an inner peripheral, circular wall 310, a ledge 312 extending radially inward from the upper edge of the inner wall 310 and a small downwardly directed annular wall 314 extending from the inner edge of the ledge 312 (see FIG. 55).

Figure 55:
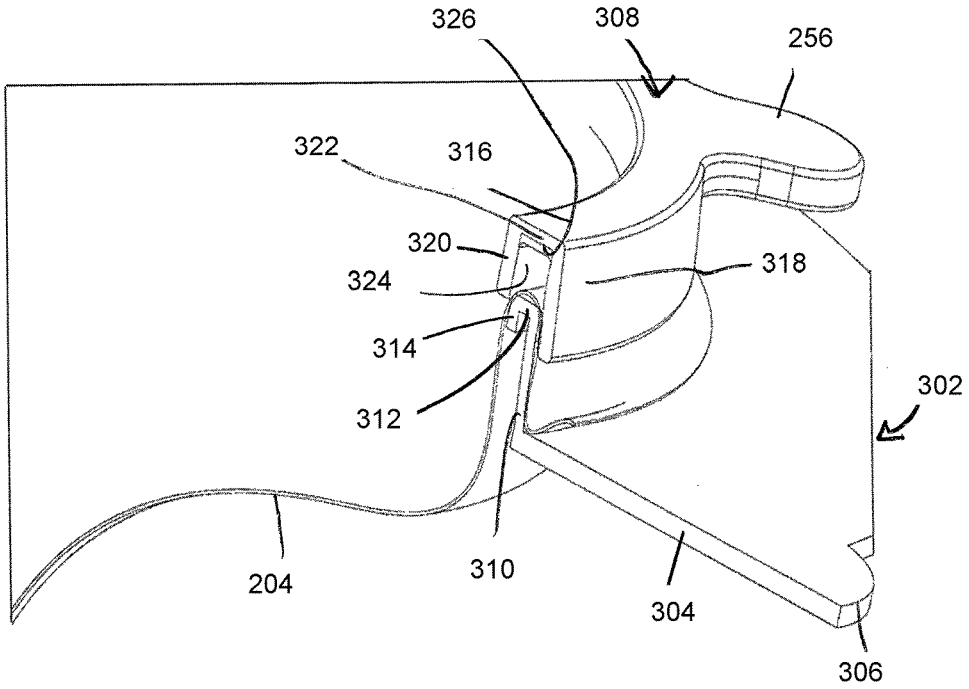
FIG. 55 is an enlarged view of the engagement between the closure component and the insert of the bag securing assembly of FIGS. 52-54.

The closure component 308 includes an annular portion 316 having a U-shape cross-section (see FIG. 55). The cross-section includes an outer wall 318, an inner wall 320 and a transverse wall 322 which together define a channel 324 oriented downward. When engaged with the annular disc 304, the outer wall 318 surrounds and presses the bag 204 against the inner wall 310 of the annular disc 304, the inner wall 320 is inward of and presses the bag 204 against the annular wall 314 of the annular disc 192 and the transverse wall 322 presses the bag 204 against the ledge 312 (see FIG. 55). This thus provides three bag-engagement surfaces or points of pressure of the closure component 308 against the insert 302.

FIG. 55 also shows a gasket 326 arranged in the channel 324. The closure component 308 may be over-molded or in-molded with this gasket 326, e.g., with the gasket 326 generally being considered a rubberized or plasticized gasket-like material. A benefit of the gasket 326 is that it can reduce the slippage of the bag 204 and allows rotational movement of the closure component 308 to cause rotation of the bag 204. (The gasket 326 may be provided in other closure components having a channel as disclosed herein.)

As shown, the gasket 326 is on the underside of the transverse wall 322. However, a gasket may additionally or alternatively be provided on the inner side of the outer wall 318 and/or on the inner side of the inner wall 320 defining the channel 324.

Figure 52:
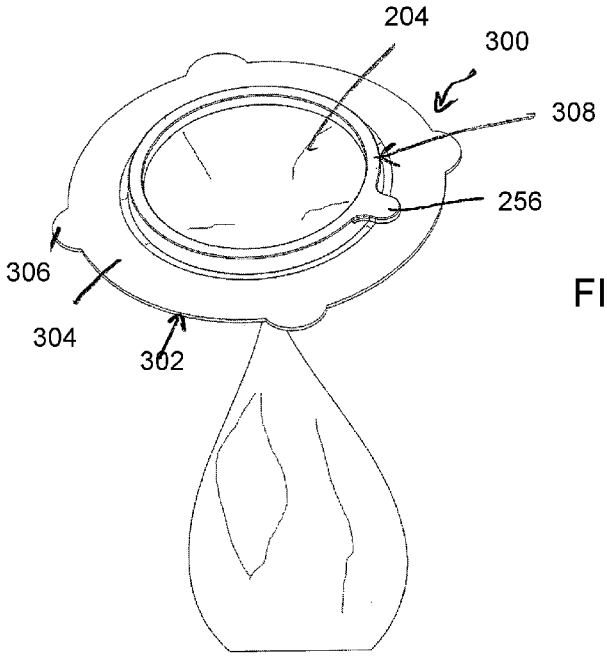
FIG. 52 is a view of another bag securing assembly with a bag in accordance with the invention with its closure component in a position in which the bag is not twisted.

In this embodiment, the bag 204 is rotated by rotating the closure component 308. For example, the closure component 308 may be in an initial position as shown in FIG. 52, the position of the tab 256 indicates this position. Then, by rotating the closure component 308 clockwise to the position shown in FIG. 53 or counterclockwise to the position shown in FIG. 54, e.g., by grasping the tab 256, a twist is formed in the bag 204 (assuming the waste in the bag is held against rotation, the relative movement of the upper region of the bag 204 relative to the waste held stationary causes formation of a twist). This clockwise rotation would be effected after insertion of a waste object into the bag 204.

Figure 53:
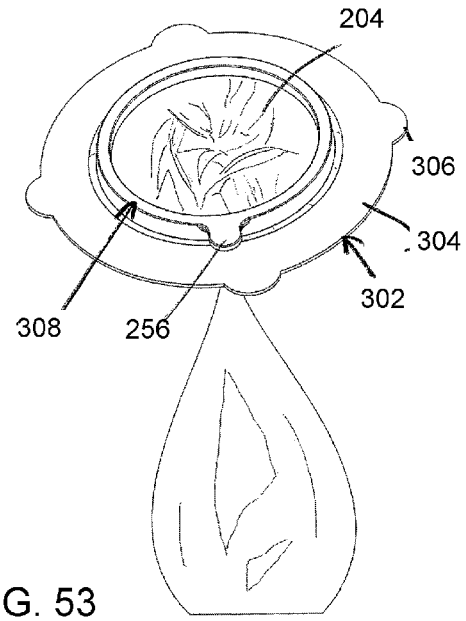
FIGS. 53 and 54 are view of the bag securing assembly of FIG. 52 with its closure component in a position in which the bag is twisted.
Figure 54:
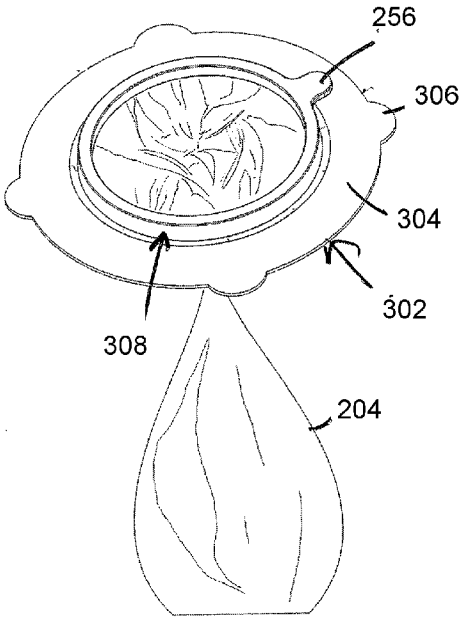

To open the bag to prepare for insertion of waste, the closure component 308 is rotated counterclockwise from the position shown in FIG. 53 to the position shown in FIG. 52 and clockwise from the position shown in FIG. 54 to the position shown in FIG. 52, to untwist the previously formed twist (assuming the waste in the bag is held against rotation, the relative movement of the upper region of the bag 204 relative to the waste held stationary causes the previously formed twist to untwist). The waste is then inserted and thereafter, the closure component 308 is again rotated clockwise. The reverse rotational movement may be provided, i.e., clockwise to untwist the bag and counterclockwise to form a twist in the bag.

When it is desired to remove the bag 204 of waste, it is often desirable to avoid exposure to offensive odors as the bag is lifted and a knot is tied at the end. By twisting the upper region of the open bag to form a twist with the closure component 308, upward draft of odors from the waste below is prevented. After removal of the closure component 308, it is possible to tie a knot above the temporary twist and have a better chance to keep the offensive odor or bacteria contained. Thus, a temporary knot or twist may be formed by using the least amount of the open bag. Actually, the twist material is likely to come from the bag below fractionally, since the upper region is secured by the closure component 308.

The embodiments in FIGS. 33-55 generally represent a bag securing assembly for use in any number of different types of waste disposal devices or waste containers, and that has a first part, a base or bag support, having a rim over which a bag is draped and a second part, a trapping, closure or securing component, that selectively traps or secures the bag to the base to prevent relative movement between the secured part of the bag and the base when engaging therewith. The base may be movable relative to the waste container or fixed in position, e.g., via projections on the base. The base may be a unitary component or have two parts that are connected together. The trapping component may be pivotally attached to the base or to the waste container.

The trapping component is configured to trap the bag against the base in a variety of different ways. In a first manner, the trapping component traps the bag only at the top edge of the bag, e.g., by pressing the part of the bag overlying a top edge of the base against the top edge of the base. This pressure prevents the bag from being drawn down into the waste-receiving compartment of the waste disposal device as the bag fills with waste.

In another configuration, the trapping component traps the bag on the top and at least one side edge (the outside or inside edge) thus adding an additional level of surface engagement which makes the bag even more secure. To this end, the trapping component may have an annular portion that has a T-shaped or L-shaped cross-section (to provide one or two sides or surfaces of engagement against the bag), or a U-shaped cross-section (to provide three sides or surfaces of engagement against the bag), In the latter case, the channel of the annular portion defining the U-shaped may be tapered to accommodate a potentially required draft required to pull the trapping component out of an injection molding device (which is the preferred process). This three-surface engagement of the trapping component with the bag serves to envelop the bag that increases the force preventing the bag from being dragging down into the waste-receiving compartment of the waste disposal device as the bag fills with waste.

When the trapping component is not attached to the base or to the waste disposal device, it may be in the form of a free standing (non-pivotable) pinch ring. Such a pinch ring may be configured to trap the bag with an interference engagement like a hoop (as disclosed above, e.g., in FIG. 30). A free-standing, non-pivotable hoop may also be provided with inner or outer wall engagements (detents) for improving securing of the bag. Alternatively, the "L", "T" or "U"-shaped channel trapping component may be configured to provide an interference fit.

Preferably, the trapping component has a tab that eases removal of the trapping component when the bag is full and must be changed. Multiple tabs may be provided. The tab also may aid in pressing the trapping component against the base. The trapping component may also be considered as a pivotable pinch ring that is connected to either the waste disposal device or be part of the base. The tab in this embodiment will assist in securing a new bag, as well as enable quick release of the trapping component from the base for bag removal.

Another engagement that should trap the bag utilizes the pivotable point and an opposing end point to trap the pinch ring in at least two points (preferably at opposing ends). One end of the pinch ring may thus be trapped by a retainer situated opposite the location at which the pinch ring is pivotally attached to the base or waste disposal device. A quick release of the tab is accomplished by moving the tab release end, which may be flexible, whereby the pivotable pinch ring can either be released or if cocked at a slight angle it may spring up. For springing up or be released, it is preferable, although not inoperative, for the pinch ring to be free of detents that might impede its release. A two-part entrapment is sufficient to keep the bag from creeping as long as engagement is a secure fit.

It is, in some embodiments, to configure the trapping component to further engage with a bag along that portion of the trapping component extending between an annular part that overlies a top edge of the base and an attachment portion. This extension portion may press the bag since its bottom edge can rest on an excess portion of the bag that is draped over the top edge of the base. This thus provides four points of pressure of the trapping component against the base. If the bag is not draped sufficiently over the top edge of the base, yet the annular part of the trapping component has a "U"-shaped channel, then there would only be three points of pressure of the trapping component against the base. Similarly, for a "T"-shaped channel, there would only be two points of pressure of the trapping component against the base, and for an "L"-shaped channel, then there would only be one point of pressure of the trapping component against the base.

If the bag is shorter than the inner length of the waste disposal device and hangs, as in a conventional waste disposal device that forms twists in the hanging portion of the bag, securing the bag at the upper region from being dragged down by weight is critical. Whereas, in other conventional waste disposal device, it is preferable that the bag have slack. Yet, this too requires that the upper region holding the bag be secure. For conventional waste pails for general use in households, offices, etc., it is preferable for the bag to be substantially the same interior volume or larger than the interior volume of the waste disposal device.

In some embodiments, it is possible to provide drop-in inserts to retrofit existing pails with conventional inner liners that require lifting up the liner and wrapping a substantially larger bag opening to struggle to wrap it outside the upper region of the insert (e.g., the embodiment shown in FIGS. 33-36 wherein the base has the same form as a conventional liner support). Often, this requires more than one attempt to accomplish the task. An insert such as shown in FIGS. 33-36 should provide a more manageable fitted bag and at the same time eliminate the redundant inner liner. The inner liner can here be looked at as substantially a pail within a pail. A sturdy, tear resistant bag will accomplish the same task. An inner liner will often need to be thoroughly washed.

As shown in FIGS. 47 and 48, the base may be made of multiple parts, e.g., two parts, instead of having a unitary or integral construction as in other disclosed embodiments. When having a unitary construction, the base may be provided with an attachment structure to enable attachment of the trapping component to the base, or without such an attachment structure, e.g., when the trapping component is attached to the waste disposal device. When having a multi-part construction, an inner insert may fit interchangeably in conventional waste disposal device, such as waste disposal device sold by Munchkin Inc. The insert may be configured to fit the inner opening of a foldable header of the Munchkin waste disposal device. Different size inner inserts may be provided with different height to accommodate different pail designs.

It is also possible to configure the bag securing assembly as a retrofit for other existing waste disposal devices, such as the Playtex Diaper Genie™, the Munchkin Arm & Hammer™, the Munchkin, and other pails of other manufacturers. Whereas Diaper Genie™ has a cartridge of continuous tubing in its operation, one such design using the invention mimics the outer dimensions and would fit into the Diaper Genie™ pail and would not interrupt the current functionality of the way the pail works. An advantage of the bag securing assembly of the invention is there would be no more need to cut the continuous tubing. There would have fewer odors from inner open bags that need tying and contain strong odor when doing so.

To tie a full bag, the bag securing assembly may include a tie string, or a press and seal end, or be configured to allow tying of the top of the bag. An inner cutting blade built into the Diaper Genie™ pails is not needed. Since over time, the blade dulls and is not changeable and cutting can become an unpleasant struggling task in lengthening the time to cut the bag and tie a knot on the filled bag with dirty smelly diapers, this issue is avoided with the invention. Another issue avoided is that when starting a new bag in the Diaper Genie™, one needs to tie a new knot on the open flexible tubing and then drag it down for the bag to begin the filling cycle again. The required time to accomplish this cumbersome task is far longer than utilizing a single bag that is already sealed at the bottom and quickly mounted in the upper open region as in the invention.

Another advantage is, whereas in the Diaper Genie™ cartridge, you never know when it is empty until you discover, often, there is not enough left to make one last bag. Also, tying a Diaper Genie inner tubing to form a knot on the lower region for waste containment requires quite a bit more bag than a simple seal which has no waste. The upper region will also require tying two more knots after cutting the bag with the built in inserted blade: one for the bag to be removed and the other to start a new bag. Over the length of the entire tubing contained in the Diaper Genie™ refill canister, one can assume that several usable lengths of tubing are sacrificed by the consumer's liberal use of tying knots. Liberal or conservative, you use accumulated lengths of tubing that add to costs and shorten the cycle of usability in a cartridge. There are several companies offering replacement cartridges for the Diaper Genie™ system(s). Target and Munchkin are two that are offering cartridges. While they may have cartridges at somewhat lower prices, they nevertheless suffer with the same wasteful and expensive characteristics. The consumer pays dearly for convenience.

It is possible to retrofit the invention to work with the Munchkin Arm & Hammer, or Munchkin Diaper pails by either replacing their current bag that is welded to an expensive foldable polypropylene injection molded header which folds to a handle for removal of the bag. The current bag is generally considered to be a single use bag which is pleated and adds yet more expense for production and to the end user. The invention can either utilize the polypropylene ring (after removing the pleated bag) and insert an inner ring insert that will permanently engage the inner ridge of the Munchkin Arm & Hammer Diaper Pail™ opening. This inner ring can now accept a single use bag, one that would cost far less than a complicated bag with costly header. It is possible, and for convenience, to replace Munchkin's pivotable foldable polypropylene header which is welded to a folded and pleated bag with a one piece unit with a potentially built-in pivotable pinch ring which will now accept single use bags for far less than existing diaper pail refills. These refills can cost many dollars for a box containing just a few bags. By using an insert and closure component according to any of the embodiments disclosed herein, a suitable product is provided and at the same time, a non-biodegradable carbon footprint is reduced.

The bag securing assembly may be used with or without the membranes as in some of the embodiments disclosed above. It may be used with any conventional waste disposal device. The shape of the bag securing assembly may be conformed to the shape of existing or newly designed waste disposal devices. Also, any inner liners of such existing waste disposal devices are rendered unnecessary.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A waste container for use with a bag, comprising:

a base defining a waste-receiving compartment;

an insert supported on said base, said insert including an annular disc having an inner bag-engagement edge region defining an aperture and at least one bag-engagement edge, an outer edge region defining an exposed outer edge of said annular disc facing away from said aperture, and a retainer arranged on said annular disc at said outer edge region, said at least one bag engagement edge and said retainer being elevated in a common direction from said annular disc, said retainer being situated between said exposed outer edge of said annular disc and said at least one bag-engagement edge;

a closure component including an annular part and a tab situated outward of a radially outer edge of said annular part and extending beyond said annular part in a direction radially outward from said annular part, said closure component having a first engagement position in which said tab of said closure component engages with said retainer of said insert and the bag when present is pressed by said annular part of said closure component against said at least one bag-engagement edge of said annular disc of said insert to thereby cause said closure component to fix the bag to said insert and prevent movement of the bag relative to said insert, and a second non-engagement position in which said tab of said closure component is not engaged with said retainer of said insert and the bag is not fixed to said insert to enable removal of the bag from the waste disposal device and placement of a new bag into the waste disposal device, said closure component being movable between the first and second positions; and a lid attached to said base and that is movable between a first, closed position covering the opening of the bag when fixed by said closure component to said insert and a second, open position in which it does not obstruct the opening of the bag when fixed by said closure component to said insert.

2. The waste container of claim 1, wherein said closure component is attached to said insert.

3. The waste container of claim 1, wherein said inner edge region of said insert further includes an inner wall, a ledge extending radially inward from an upper edge of said inner wall and an annular wall extending downward from an inner edge of said ledge, said annular part of said closure component having a U-shaped cross-section defining a channel having an opening facing said insert, said closure component being positioned in the first position such that said inner wall, said ledge and said annular wall are received in said channel around an entire periphery of said insert and said at least one bag-engagement surface thereby constituting three bag-engagement surfaces.

4. The waste container of claim 3, wherein said closure component is attached to said insert.

5. The waste container of claim 1, wherein said retainer is flexible and includes a vertical portion, a lip proximate a top of said vertical portion and under which said tab is received, a flange proximate the top of said vertical portion opposite said lip and an angled surface arranged above said lip to facilitate placement of said tab under said lip as said retainer flexes said tab being configured to be urged into engagement with said retainer against the flexure of said retainer and said retainer being configured to require flexure thereof to enable release of said tab from engagement with said retainer.

6. The waste container of claim 3, wherein said tab projects outward from said annular part at a location opposite an attachment point at which said closure component is attached to said insert.

7. A waste container for use with a bag, comprising:

a base defining a waste-receiving compartment;

a bag support on said base and that includes an annular disc, an annular rim arranged on said annular disc and defining an aperture, and a retainer arranged on said annular disc, said rim being adapted to engage a peripheral edge of the bag around an opening of the bag while maintaining the opening of the bag unobstructed with the bag extending into said compartment, said rim and said retainer being elevated in a common direction from said annular disc, said retainer being situated between an outer radial edge of said annular disc facing away from said aperture and an outer edge of said rim facing away from said aperture; and a closure component including an annular part and a tab situated outward of a radially outer edge of said annular part and extending beyond said annular part in a direction radially outward from said annular part, said closure component being configured to selectively cooperate with said rim when said tab is engaged with said retainer to press the bag when present against said rim when said closure component cooperates with said rim to thereby cause said closure component to fix the bag to said bag support only when said closure component cooperates with said rim and said tab is engaged with said retainer and prevent movement of the bag relative to said insert, an upper region of the bag being positionable around said rim and the bag being separable from said rim when said closure component does not cooperate with said rim and said tab is not engaged with said retainer to enable removal of the bag from the waste disposal device and placement of a new bag into the waste disposal device, said closure component being movable between a position cooperating with said rim and a position not cooperating with said rim.

8. The waste container of claim 7, wherein said retainer is flexible and includes a vertical portion, a lip proximate a top of said vertical portion and under which said tab is received, a flange proximate the top of said vertical portion opposite said lip and an angled surface arranged above said lip to facilitate placement of said tab under said lip as said retainer flexes said tab being configured to be urged into engagement with said retainer against the flexure of said retainer and said retainer being configured to require flexure thereof to enable release of said tab from engagement with said retainer.

9. The waste container of claim 7, further comprising a lid attached to said base and that is movable between a first, closed position covering the opening of the bag when fixed by said closure component to said bag support and a second, open position in which it does not obstruct the opening of the bag when fixed by said closure component to said bag support.

* * * * *